US005296641A

United States Patent [19]

Stelzel

[11] Patent Number: 5,296,641

[45] Date of Patent: Mar. 22, 1994

[54] COMMUNICATING BETWEEN THE INFRARED AND MIDI DOMAINS

[76] Inventor: Jason A. Stelzel, 13623 S. Berendo Ave., Gardena, Calif. 90247-2023

[21] Appl. No.: 849,734

[22] Filed: Mar. 12, 1992

[51] Int. Cl.[5] ..... G10H 7/00

[52] U.S. Cl. ..... 84/602; 84/645; 250/338.1

[58] Field of Search ..... 84/600-602, 84/723-734; 250/338.1-353; 356/51; 364/488-491

[56] References Cited

U.S. PATENT DOCUMENTS 4,794,838 1/1989 Corrigau, III ..... 84/600
4,870,575 9/1989 Rutenberg ..... 364/488
4,984,499 1/1991 Schille ..... 84/734
5,103,108 4/1992 Crimmins ..... 250/338.1

*Primary Examiner*—Stanley J. Witkowski
*Attorney, Agent, or Firm*—Charles Berman; Michael B. Farber

[57] ABSTRACT

A system for receiving and subsequently either transforming or transceiving signals between the MIDI domain and the IR domain. MIDI devices are cable connected to a transceiver which translates MIDI signals into selected IR signals to operate IR devices. A computer through a MIDI interface connected with the transceiver can operate IR devices. The transceiver can also control the operation of selected devices as a result of IR signals presented to the transceiver's infrared input.

26 Claims, 13 Drawing Sheets

Entire Diagram - 200

Entire Diagram - 200

COMMUNICATING BETWEEN THE INFRARED AND MIDI DOMAINS

BACKGROUND

Being able to translate information and command signals between different domains is valuable. This invention relates to communicating infrared signal messages to associated infrared receivers via MIDI signals and vice versa.

The term "infrared signal" ("IR") means radiation at infrared wavelengths. The signals are encoded in a language understood, for instance, by conventional home entertainment systems such as TVs and VCRs.

The term "MIDI signal" means a signal in the Musical Instrument Digital Interface language. MIDI is a hardware/software specification which makes possible the exchange of musical information between different musical instruments or other devices, such as synthesizers and keyboards. It is a language for sending performance information to musical instruments. There is a MIDI specification 1.0 which defines the language in terms of bit structures for each command in the MIDI language. Further details of MIDI are set out in the MIDI 1.0 Detailed Specification, Document Version 4.1.1, February, 1990, published and distributed by the *International MIDI Association* of Los Angeles, Calif. 90056, Copyright 1958, the disclosures of which are incorporated by reference herein.

The terms "MIDI-domain" and "IR-domain," respectively, refer to the form which a specified message takes during signaling for respectively, MIDI and IR devices.

It is well known to use IR remote controls for interacting with home entertainment equipment such as VCRs, TVs, and stereos. The remote operates on the general principal of transmitting IR signals through the air to command units. Information is encoded using different bandwidths of radiation in the IR spectrum and sent at the various rates of between 500 and 1000 bits per second.

It is also known to use MIDI signals for communicating between different musical instruments or entities. This operates on the general principals of transmitting electrical MIDI signals along cables at the rate of 32,000 bits per second or 31.25K baud from one unit to another.

A need exists for communicating information between IR and MIDI formats or domains.

SUMMARY

By this invention, there is provided a system for effectively interacting between IR signals and MIDI signals. Information can be translated between the IR and MIDI formats and vice versa so that devices in the one format can be effectively controlled by signals generated in the other format.

According to the invention, there is a transceiver operative to receive a MIDI input signal on the one hand and to output an IR signal on the other hand. Preferably, also a MIDI output signal can be obtained to operate from an IR input signal.

The transceiver is also operative to have an IR output to activate a home entertainment system, such as a TV or CD player. The transceiver is also operative to have an IR input which can sense the transmission of IR messages fired from other remotes and allows for subsequent analysis, storage, transformation, or transception of the message. The stored message can later be reproduced in the stead of the original remote, in response to the appropriate input of either a keypad or a MIDI message to the transceiver. There is also a MIDI input and MIDI output which can activate audio-visual equipment such as musical equipment and lighting consoles (anything with MIDI input/output capability).

By this form of the invention, various devices in one domain communicate with other devices in the other domain. This allows for a device of one domain to be played or controlled by a device operating in the other domain.

One aspect of the invention is that a cable-sent electrical MIDI signal is translated either by transformation or transception means into an IR signal using software on a microcontroller, and the IR signal is transmitted through the air. For this aspect, means is provided for receiving MIDI signals by inputting signals from a MIDI device to a MIDI input jack of the transceiver which sends the message to the microcontroller of the transceiver. Internal system software instructs the microcontroller in the means of determining the IR message to be sent. Also means is provided for signaling IR devices by outputting signals from the microcontroller to the IR output LED of the transceiver and subsequently to an IR-aware device designed to react to a specific IR message in a fashion specifically associated with the message.

Another aspect of this invention is translating MIDI signals received along path 130 via either transforming or transceiving methods into IR signals which is effected by software on the microcontroller. For this aspect, means is provided for receiving IR signals (consisting of on and off pulses of infrared light) which are converted into electrical signals by an infrared receiver and sent to a microcontroller. The microcontroller then determines the appropriate MIDI message to be transmitted and sends this information to the MIDI output section of the transceiver.

In a preferred form of the invention, controlling operational communication to either MIDI devices and/or IR devices is provided by a control keypad on the transceiver, which is a remote control unit.

A preferred form of the transceiver includes a microprocessor for receiving and outputting MIDI signals and for receiving and outputting IR signals. Preferably a memory associated with the microprocessor buffers and stores message data for a chip constituting the microprocessor. The transceiver may selectively include at least one of a keypad and indicator operative with the microprocessor chip.

The transceiver preferably controls the domains between which signals can be translated. Buttons on the keypad are included to start and stop the communication of signals between domains. System Exclusive Messages are also recognized which can control any function available on the keypad.

Another preferred aspect of the invention includes the ability of the transceiver to have "learning" characteristics which allow for "replaying" specified events at a later time. This is somewhat like a real-time macro recorder. A computer interconnected to a MIDI interface can act as an intelligent controller of the transceiver for NON-real-time event control which allows for more flexible sequencing of events.

The transceiver can be operationally used either directly or interactively.

In its direct operational use:

a. the KEYPAD 301 invokes messages to both alternate domains (MIDI and/or IR) or:

b. either an IR signal (along path 130) or a MIDI signal (from any of paths 173, 173*b*, 176 being the result of signal 173 diverted along path 173*a* to MIDI interface 174, passing through gate 175, or 181 to path 190 to MIDI input 302) invokes a message of the alternate domain (either MIDI or IR, respectively)

The signals are sent to MIDI compatible devices, such as keyboards, mixers, light controllers, and sequencers, and/or to IR compatible devices such as video cassette recorders, CD players, TVs, and stereos.

In one preferred form of interactive operational use, communication includes a compatible computer configured to operate with a MIDI interface to and from the transceiver. Typically, the user would disable KEYPAD to IR messages while leaving KEYPAD to MIDI messages intact. The computer would receive a MIDI signal generated by the transceiver, from a button pressing and would then transmit an appropriate MIDI signal back to the transceiver, determined by the particular program running on the computer. The resulting MIDI message generated by the computer could trigger an associated IR message in the transceiver and thus would provide for a user's interactive use of the transceiver via computer. In other examples of interactive operational use, communication includes any MIDI-processing device configured to operate with bidirectional MIDI messaging from and to the transceiver.

The invention covers both the apparatus for and the methods associated with the translation and communication of messages between IR devices and MIDI devices. Also covered is the transceiver with placing translation, transformation, transception and communication software in association with receiving, converting, compressing, analyzing, storing, recalling, transceiving, transforming, and transmitting signals between the MIDI and IR devices.

The invention is now further described with reference to the accompanying drawings.

DRAWINGS

Figure 4A:
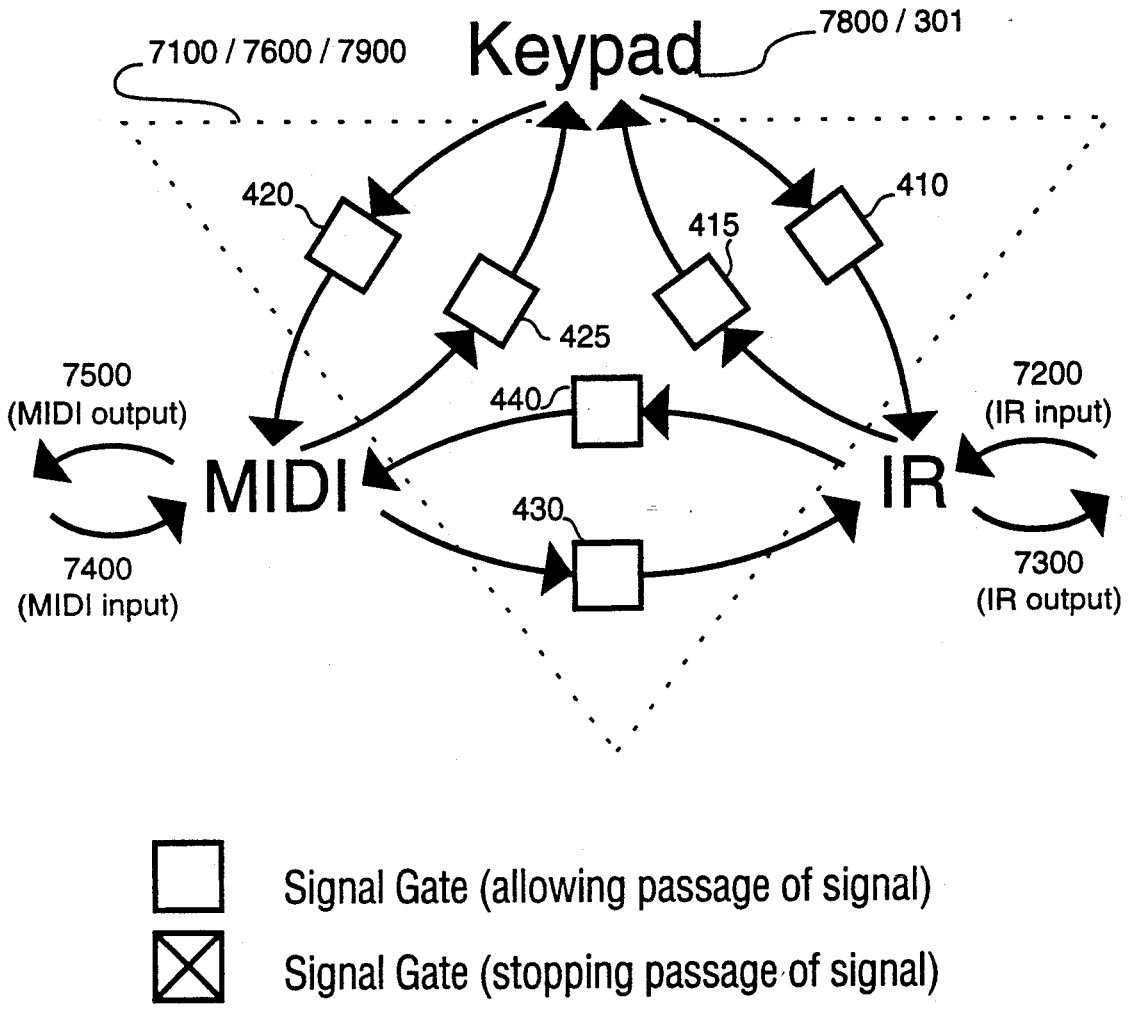

FIG. 4*a* illustrates the key sequence required for starting translation of all messages between all domains through blocks 410, 420, 430, and 440. Blocks 415 and 425 also pass messages to the keypad 301 which can respond through indicator means that a signal has entered the transceiver. The procedure for enabling all translations is as follows: Press the "Start Sending" key 319 two times with no intervening key-strokes between presses of the "Start Sending" key 319.

Figure 4B:
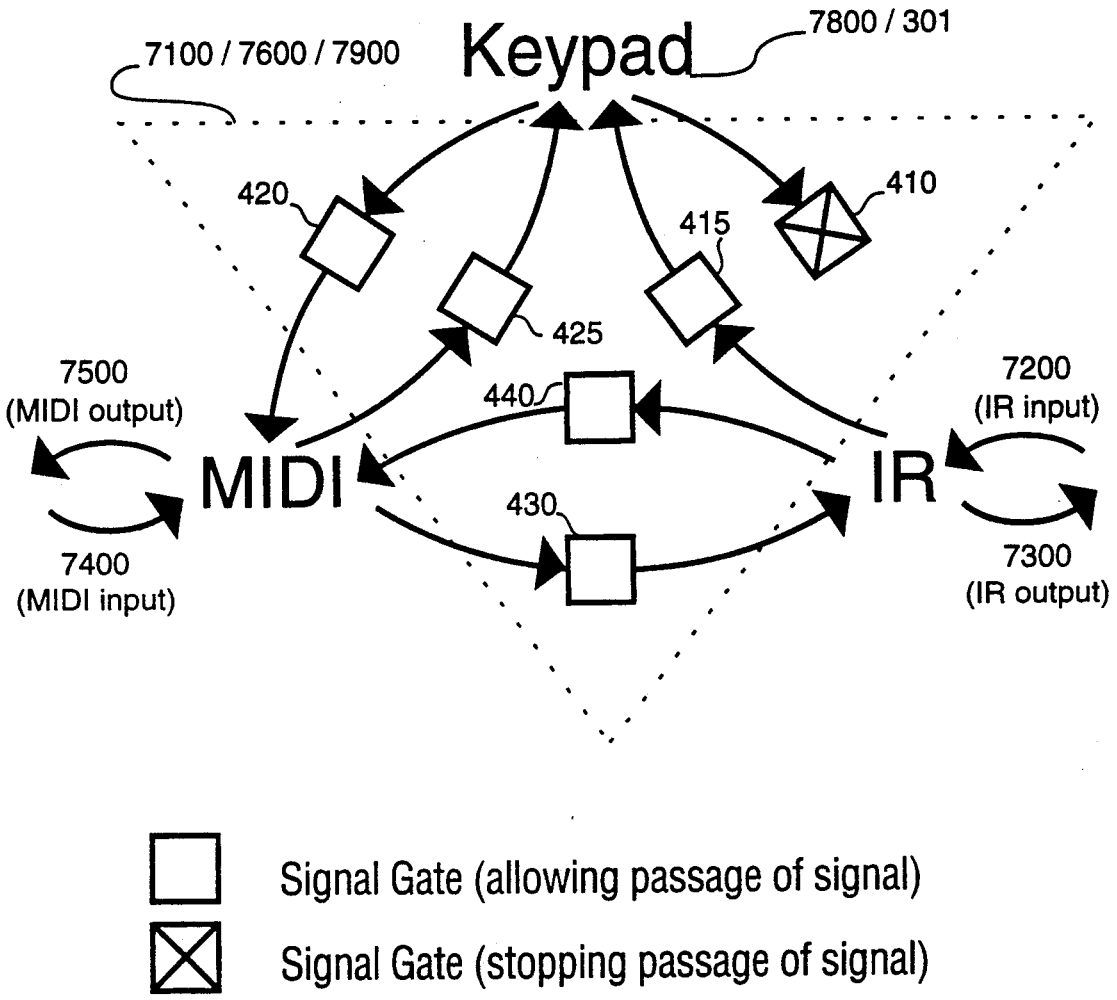

FIG. 4*b* illustrates the key sequence required for stopping messages originating from the keypad domain from being communicated to the IR domain through block 410. The procedure for this is as follows: Press the "Stop Sending" key 320 followed by "Keypad" key 312 and "IR" key 310 which indicate the domains between which communication should stop.

Figure 4C:
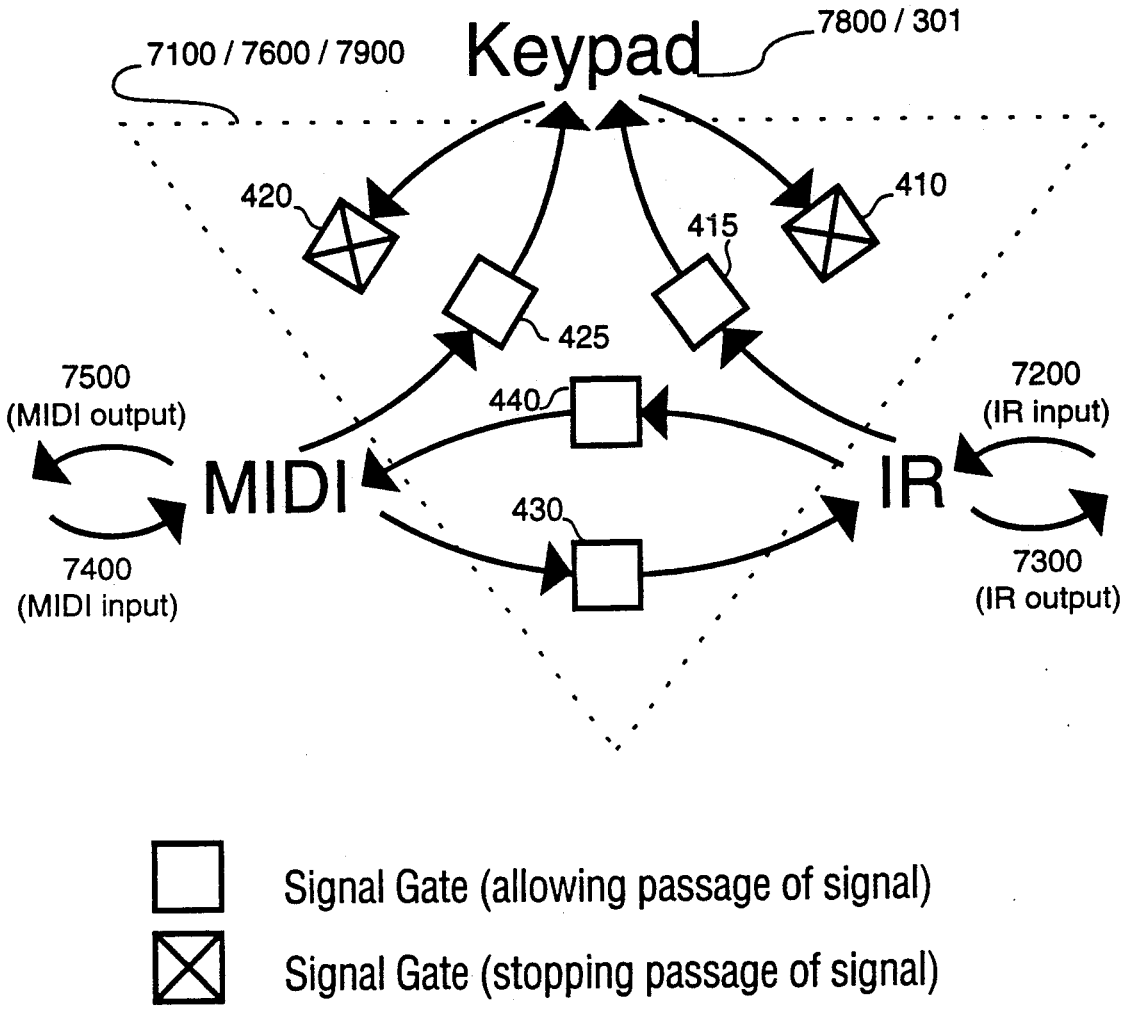

FIG. 4*c* illustrates the key sequence required for stopping messages originating in the keypad domain from being communicated to the MIDI domain through block 420. Combined with the actions taken in FIG. 4*b*, this effectively disables the keypad allowing only MIDI inputs to trigger IR outputs and IR inputs to trigger MIDI outputs. Passage of signals through block 410 continue to be stopped because of the procedure previously carried out in FIG. 4*b*. The procedure to block communication from the keypad 301 to MIDI is as follows: Press the "Stop Sending" key 320 followed by "keypad" key 312 and "MIDI" key 311 to indicate the domains between which communication should stop.

Figure 4D:
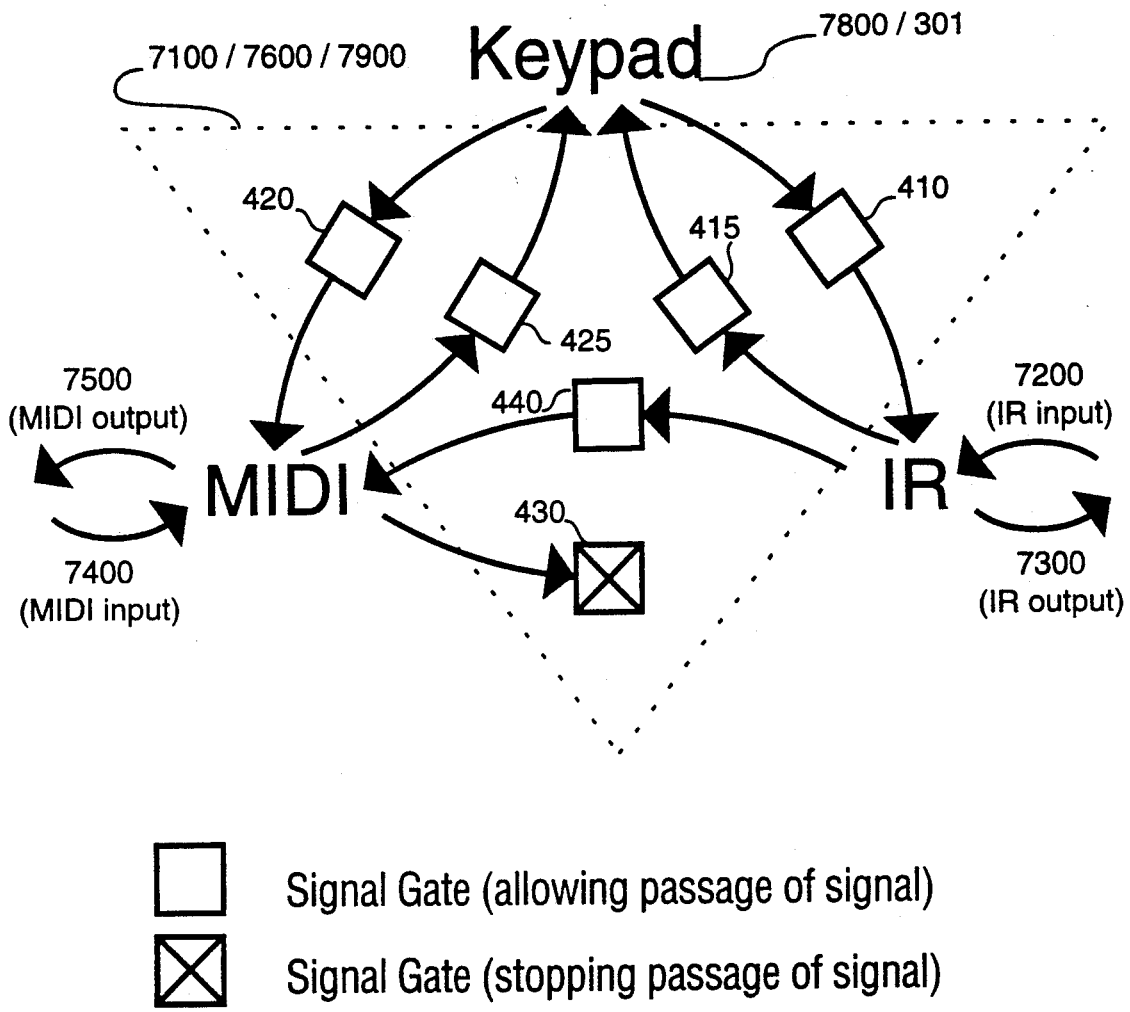

FIG. 4*d* illustrates the key sequence required for disabling MIDI's control over IR outputs by first using the commands outlined in FIG. 4*a* to restart all communications and then stopping messages originating in the MIDI domain from being communicated through block 430 to the IR domain. This returns control of the IR devices to the keypad and keeps MIDI from triggering any associated IR commands. After completing the procedure as outlined in FIG. 4*a*, the procedure for stopping communication between the MIDI and IR domains is as follows: Press the "Stop Sending" key 320 followed by the "MIDI" key 311 and "IR" key 310 to indicate the domains between which communication should stop.

Figure 4E:
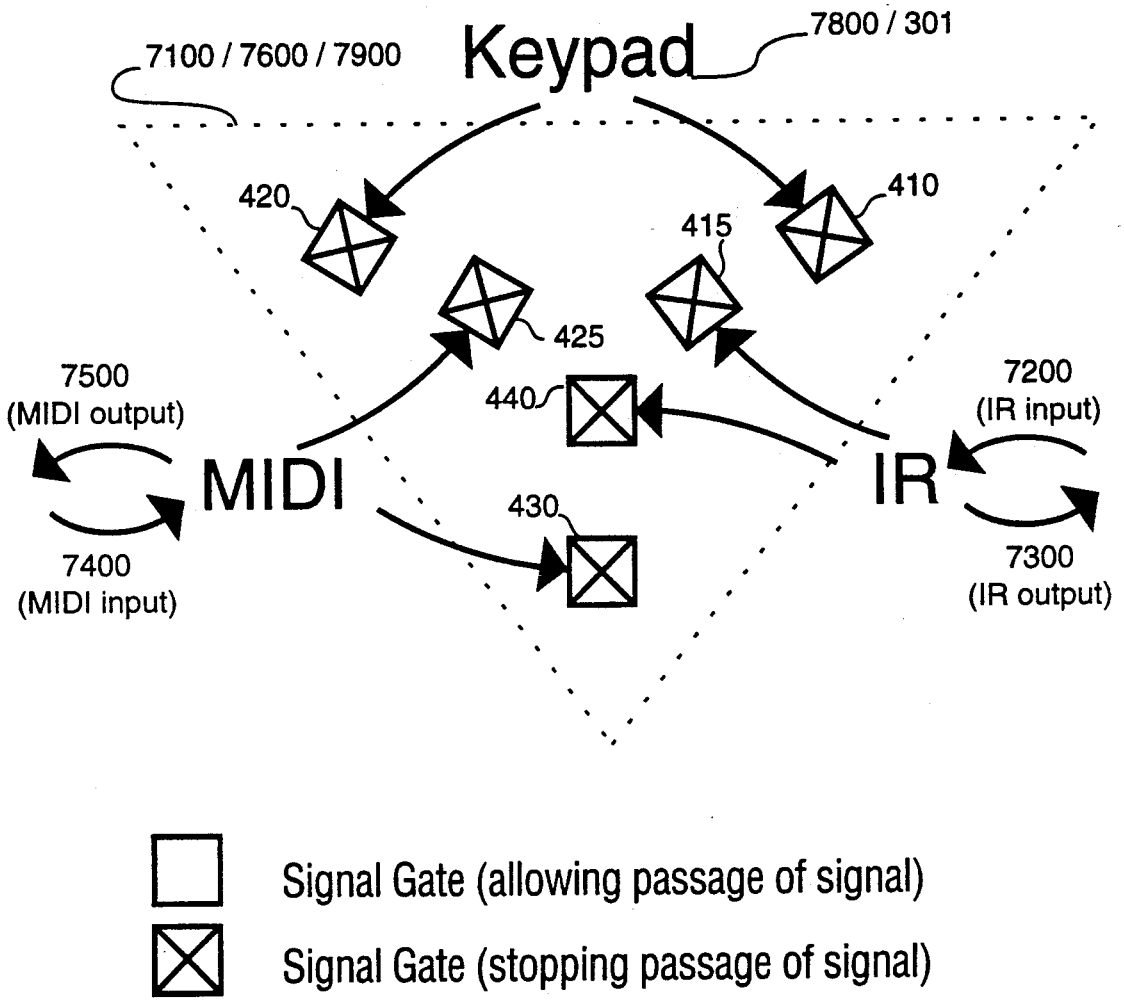

FIG. 4*e* illustrates the key sequence required for stopping translation (and therefore communication) of all messages between all domains. This halts all signals between all domains through blocks 410, 420, 430, or 440. Blocks 415 and 425 block messages to the keypad. The keypad would no longer respond through indicator means that a signal has entered the transceiver. The procedure for this is as follows: Press the "Stop Sending" key 320 two times with no intervening key strokes between presses of the "Stop Sending" key 320.

Figure 5:
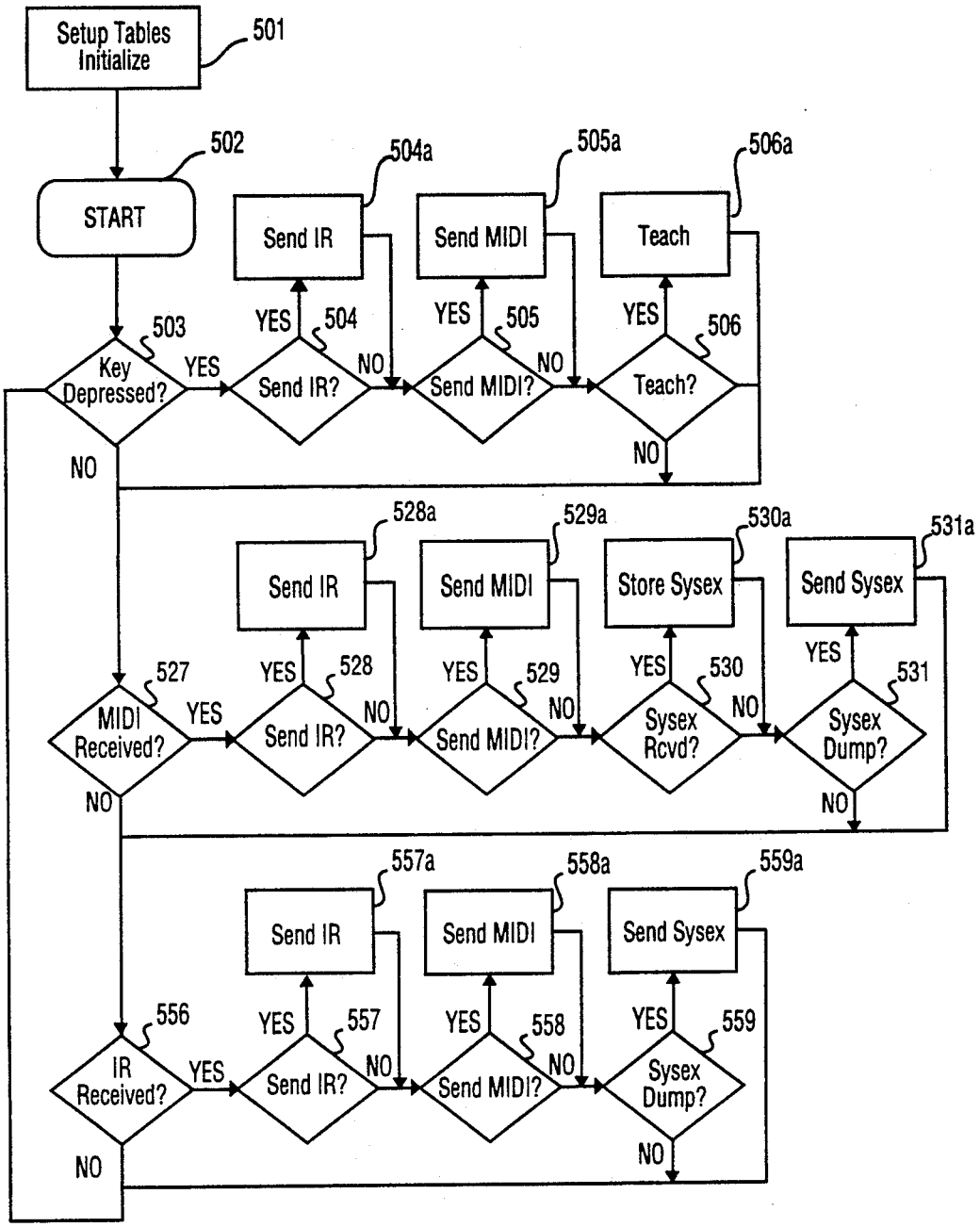

FIG. 5 is a software flow chart showing the high-level system flow of the transceiver's message processing.

Figure 6A:
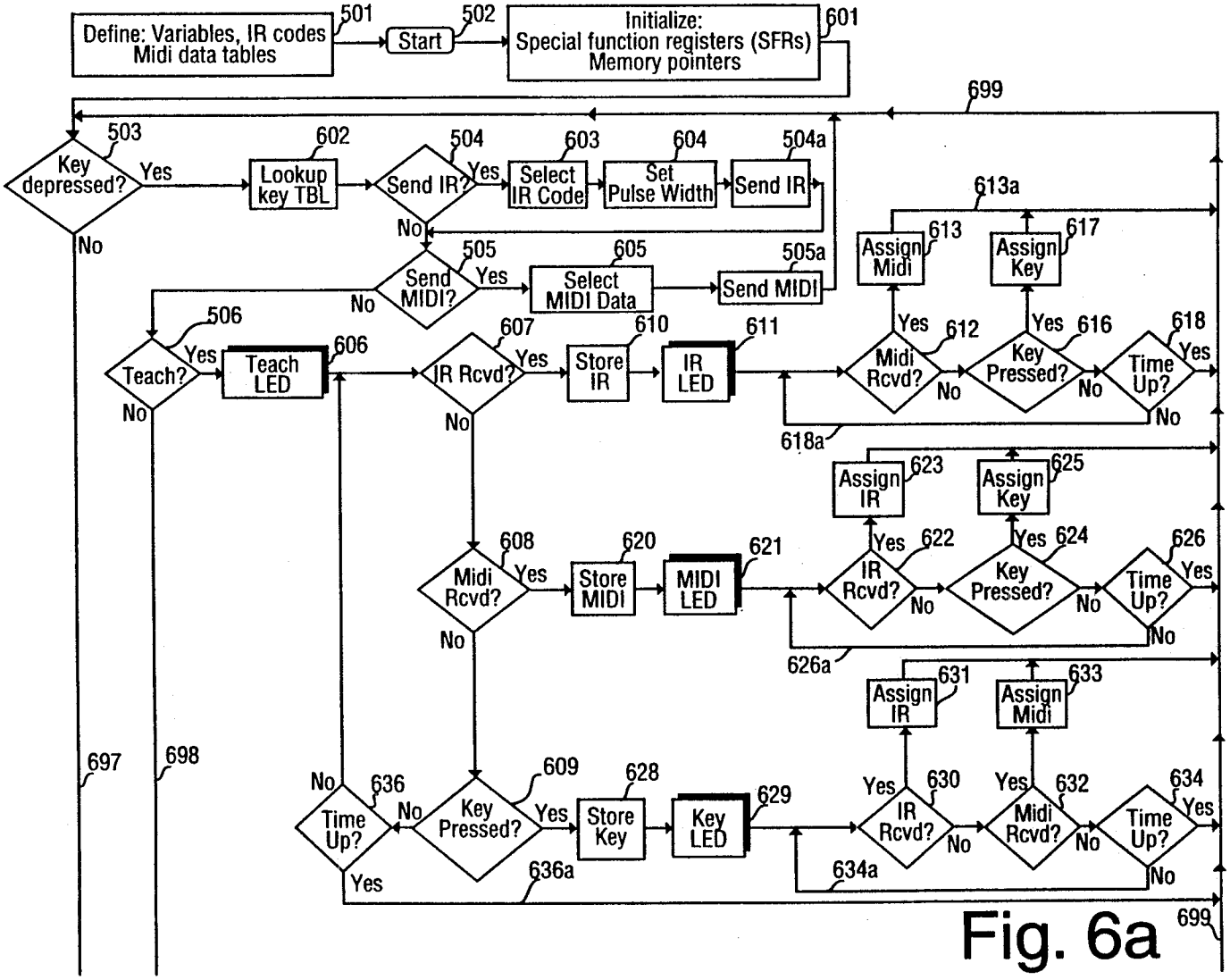

FIG. 6*a* is a software flow chart showing the middle-level systems flow of the transceiver's message processing, including initialization and IR/MIDI/Teach button processing.

Figure 6B:
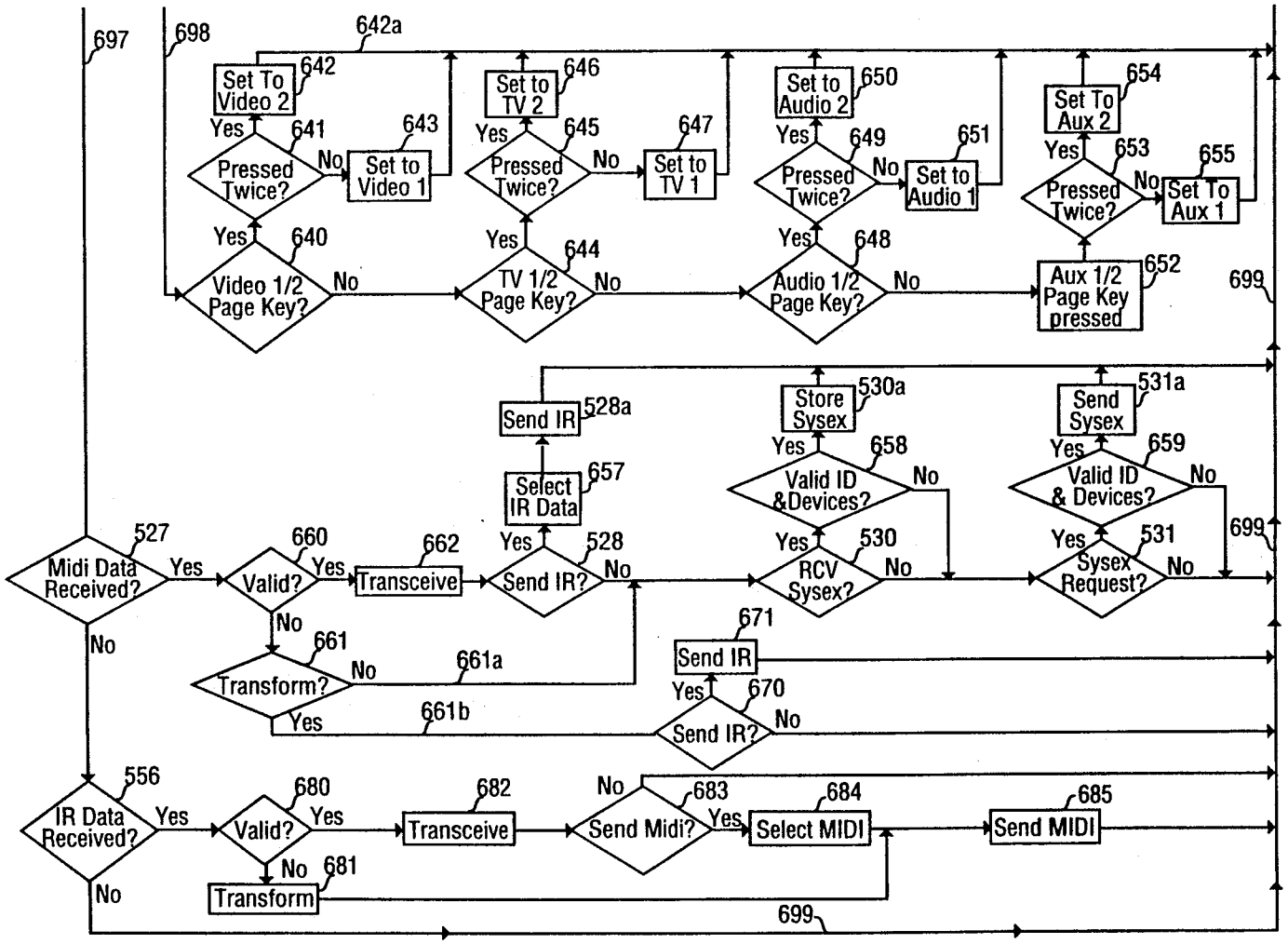

FIG. 6*b* is a software flow chart showing the middle-level systems flow of the transceiver's message processing, including page keys and signal processing.

Figure 7A:
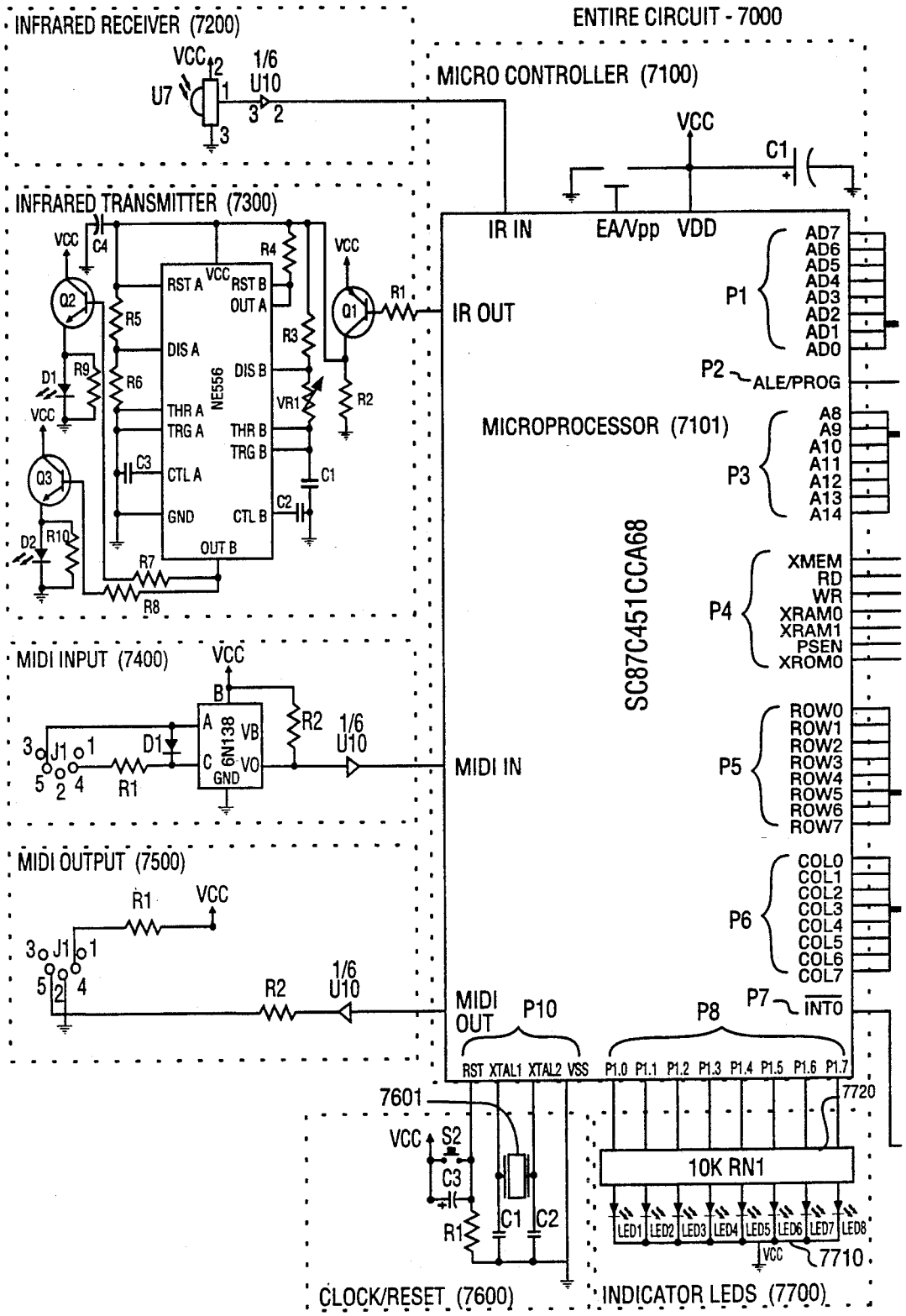

FIG. 7*a* is a schematic illustrating the electronics associated with the transceiver, including IR input, IR output, MIDI input, MIDI output, microprocessor, clock and reset circuit, and indicator circuit.

Figure 7B:
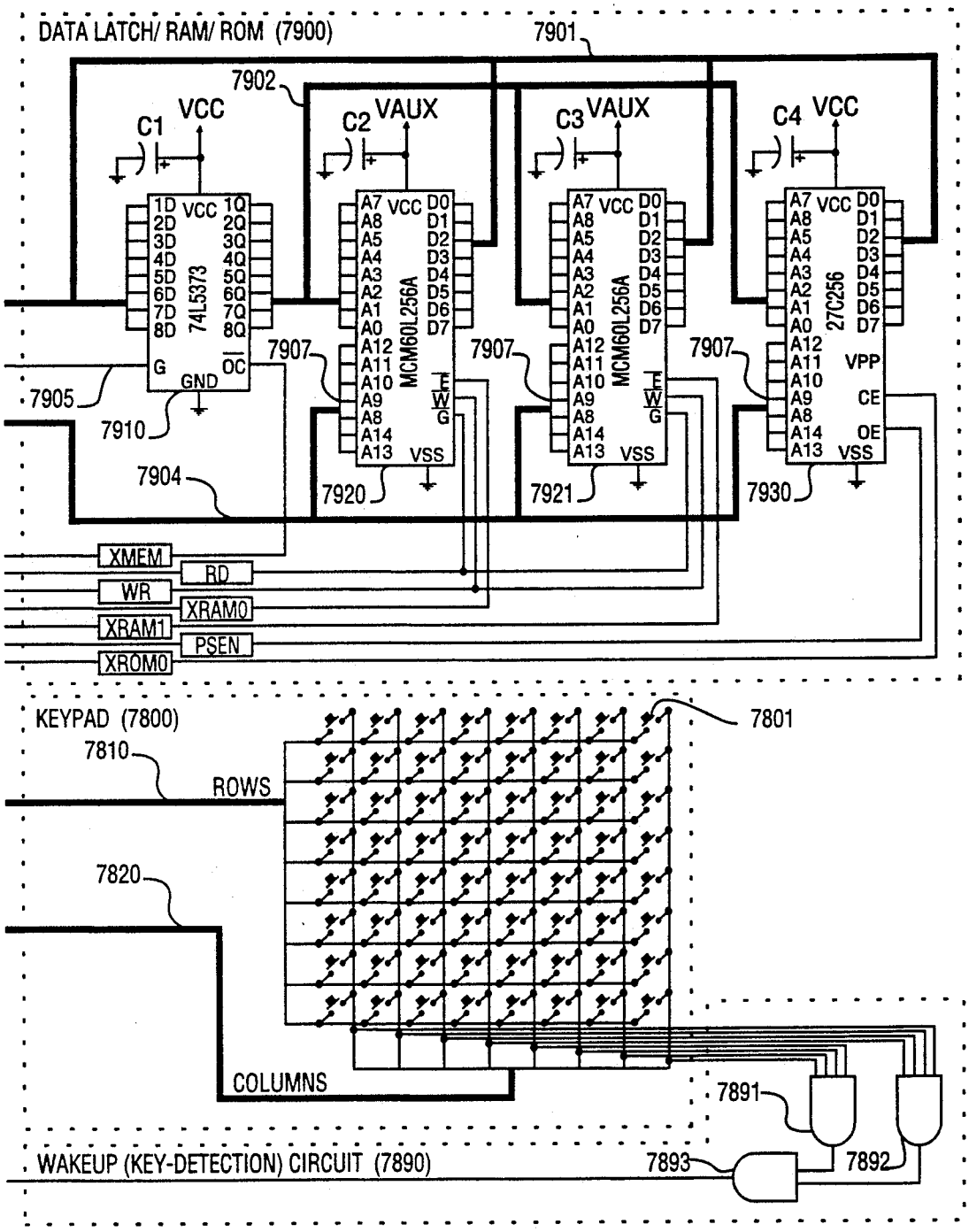

FIG. 7*b* is a schematic illustrating the electronics associated with the transceiver, including the electronics associated with the transceiver's memory and keypad.

TABLES

Table 1a illustrates a three-way lookup table system activated by pressing a key on the keypad 301. The message translation process begins at location 1 of table 1*a*. A key is pressed which happens to have an internal identification of 4. Because the trigger originated as a keypad message, it travels to the "DATA" half of the Keypad Lookup Table at location 2. The system searches for a match to the keypad's "4" message and finds one at the sixth entry in this table at location 3. An index of "6" at location 4 results from matching the data in the "DATA" column of the Keypad Lookup Table.

Having determined a valid index for the keypad message initiated, the index leaves the Keypad Lookup Table at location 5 and enters the "KEYPAD" column of the 3-Way Association Table at location 6. The system searches for a match to this newly derived index. Indexes of "16" and "9" result from matching the data in the "KEYPAD" column at location 7. Two indexes at locations 8*a* and 8*b* of the "MIDI" and "IR" columns, respectively, exit the 3-Way Association Table at locations 9*a* and 9*b*. Continuing, these indexes enter the INDEX columns of the MIDI Lookup Table and the IR Lookup Table at locations 10*a* and 10*b*, respectively. The system locates output data by matching the respective indexes within their respective lookup tables at locations 11*a* and 11*b*. Output data at locations 12*a* and 12*b* is selected and sent to the respective output ports of the transceiver at locations 13*a* and 13*b*, respectively.

Table 1b illustrates a three-way lookup table system activated by reception of a MIDI message at the transceiver's MIDI input 302. The message translation process begins at location 1 of table 1b. A MIDI message is received which happens to be "159 93" which means a "Note-On" of Note #93 occurred. Because the trigger originated as a MIDI message, it travels to the "DATA" half of the MIDI Lookup Table at location 2. The system searches for a match to the MIDI "159 93" message and finds one at the sixteenth entry in this table at location 3. An index of "16" at location 4 results from matching the data in the "DATA" column of the MIDI Lookup Table. Having determined a valid index for the MIDI message initiated, the index leaves the MIDI Lookup Table at location 5 and enters the "MIDI" column of the 3-Way Association Table at location 6. The system searches for a match to this newly derived index. Indexes of "6" and "9" result from matching the data in the "MIDI" column at location 7. Two indexes at locations 8*a* and 8*b* of the "MIDI" and "IR" columns, respectively, exit the 3-Way Association Table at locations 9*a* and 9*b*. Continuing, these indexes enter the INDEX columns of the Keypad Lookup Table and the IR Lookup Table at locations 10*a* and 10*b*, respectively. The system locates output data by matching the respective indexes within their respective lookup tables at location 11*a* and 11*b*. Output data at locations 12*a* and 12*b* is selected and sent to the respective output ports of the transceiver at locations 13*a* and 13*b*, respectively. The transceiver's keypad 301 can respond to these messages with indication means that verify the operation previously described.

Table 1c illustrates a three-way lookup table system activated by reception of an Infrared message. The message translation process begins at location 1 of table 1c. An IR message is received which happens to be identified as a series of pulses beginning with the series "15 15 12". Because the trigger originated as an Infrared message, it travels to the "DATA" half of the Keypad Lookup Table at location 2. Many more bytes of information exist in this table which has been shortened for space considerations. The system searches for a match to the IR message and finds one at the ninth entry in this table at location 3. An index of "9" at location 4 results from matching the data in the "DATA" column of the IR Lookup Table. Having determined a valid index for the IR message initiated, the index leaves the IR Lookup Table at location 5 and enters the "IR" column of the 3-Way Association Table at location 6. The system searches for a match to this newly derived index. Indexes of "6" and "16" result from matching the data in the "KEYPAD" column at location 7. Two indexes at locations 8*a* and 8*b* of the "KEYPAD" and "MIDI" columns, respectively, exit the 3-Way Association Table at locations 9*a* and 9*b*. Continuing, these indexes enter the INDEX columns of the Keypad Lookup Table and the MIDI Lookup Table at locations 10*a* and 10*b*, respectively. The system locates output data by matching the respective indexes within their respective lookup tables at locations 11*a* and 11*b*. Output data at locations 12*a* and 12*b* is selected and sent to the respective output ports of the transceiver at locations 13*a* and 13*b*, respectively. The transceiver's keypad 301 can respond to these messages with indication means that verify the operation previously described.

DESCRIPTION

Introduction

The following terms are defined as pertains to the invention.

The term "convert" refers to the process of changing a message conveyed under one physical format, i.e. light pulses, into another physical format such as electronic pulses representing the same message. There is a one-for-one correspondence between the two signals such that a simple analog circuit can provide the means for undertaking this task. No intelligent microprocessor means are needed for this step. It merely translates the message into a form usable by the microprocessor for either of the following two communication methods. In the case of an IR input signal, the on and off pulses of light are converted into on and off pulses of electrical current. In the case of a MIDI input, the signal passes through an optoisolator which performs two conversions. It converts the cable-sent electrical MIDI signal into light and then back again from light into electricity. This isolates the internal electronic components of the transceiver from any MIDI devices connected to it.

"Transceive" refers to a translation process of matching an initial command among a list of commands in one domain and supplying an associated command in another domain. A lookup table means, is connection between the two messages of alternate domains. The association is purely arbitrary and determined by the user. A microprocessor uses an algorithm to generate the alternate domain message through means of a lookup table.

"Transception" refers to the completed act of reception of a communication of a message from a device in one domain, determining its validity by searching for a match in a lookup table, subsequently selecting the associated message and transmitting it in the alternate domain.

"Transform" refers to a translation process of generating a message in an alternate domain such that it embodies characteristics of the other domain's commands. Because the two different domains have characteristics not found in each others natural domains, a preprogrammed microprocessor is involved to make the decisions on how the alternate domain message is rendered.

"Transformation" refers to the completed act of a communication across domains which means reception of a message in one domain, generation of the appropriate message in the alternate domain, and subsequent transmission of it.

"Translate" refers to the process of generating an alternate domain message using either of the two methods previously described (either transform or transceive)

"Translation" or "translator" refers specifically to the part of a transformation or transception which is responsible for determining or generating the alternate message to be sent: i.e. Which "translation" process will you use to translate the message? Or, Which "translator" will you use to communicate from the MIDI domain to the IR domain?

"Communication" refers to the process of sending a message from one device and receiving that message by the targeted device. Depending upon its use, "communication" can refer to the receipt of a message from the same domain as the originating message or receipt of a message from an alternate domain as the originating message. The latter actually involves using two of the former "communication methods" separated by a "translation" process to cross domains.

"Program Map" refers to the collection of lookup table transception programs referenced upon analysis of an input signal. Any number of maps can exist (subject to memory limitations) in the transceiver device. This transceiver device has eight such maps.

"Data Bits" or "bits" refer to the binary digits one and zero which, as an 8-digit number, constitute a byte. When referenced as a group or in a sequence they are normally thought of as occurring in word-reading order (from left to right). Example: a series of three bits followed by four more bits. When referenced specifically (as in bit 3), they are called out by their position in increasing order of value in a number from right to left. The eight bits in a byte are numbered from right to left, starting with zero, as bit 0, 1, 2, 3, 4, 5, 6, and 7. Bit 0 is the rightmost bit of a byte and bit 7 is the leftmost bit of a byte. Bit 7 is also referred to as the "high bit" or the Most Significant Bit (MSB). The MSB determines the difference between "status bytes" (MSB =1) and "data bytes" (MSB =0) in the MIDI domain. The high-bit is always the leftmost bit of a number and as such, it commands the largest multiplier for its place value (128 in the case of a byte). Therefore, any number which is 128 or higher has a "1" in its MSB.

A "byte" is a numerical value normally expressed as an 8-digit number consisting only of ones and zeros. It is sometimes called a "word" when referring to a specific byte of information among others. In contrast to bits, bytes are referenced from left to right (within a series) and counted with numbers starting from one as opposed to zero. A three-byte message contains three bytes numbered byte-one, byte-two, and byte-three.

A "Nibble" refers to any sequence of 4 binary digits (4 bits), often expressed as either the lower or upper half of a byte (having 8 bits).

"MIDI Message Element"—Any single byte of a MIDI message. Most MIDI messages usually consist of two or three bytes.

"MIDAM"—MIDI Input Domain Algorithm Message —A definition for determining what elements of a MIDI message need to be matched to trigger the firing of an associated IR message. It begins with a status byte followed by a variable length sequence of bytes which denote a series of MIDI-message elements for which to test for matches to incoming MIDI data. A zero is placed in the byte immediately following the pointer to a particular MIDI message element as a place holder. The zero will be replaced when the algorithm is used to produce a MIDPM (see next definition).

"MIDPM"—MIDI Input Domain Program Message—the result of using a MIDAM to capture specific MIDI message elements for the purposes of later comparison to incoming MIDI data. Each MIDI message element replaces a zero held for it in (typically) even numbered bytes within a MIDAM, starting with the 4th byte.

"Status Byte" or "Status" as associated with MIDI means binary bytes preceding and following data bytes with a MSB (most significant bit) of 1 followed by a 3 bit identifier for control description and followed by a channel identifier. In the event that all 3 bits of the 3-bit identifier are "111," then the following 4-bits identify 1 of 16 System Messages that apply to all channels and thus are not channel-specific. "Data" or "Data Byte" associated with MIDI means bytes containing information about: instrument notes (e.g. A flat), their velocity (a number from 0 to 127), pressure value (a number from 0 to 127), sound modification, or program number, as is appropriate to the individual command. Two data bytes are sometimes used to generate numbers up to ±16384. Several data bytes can be sent when a System message is invoked.

"Data Bytes" or "Data" as associate with MIDI means binary bytes with an MSB of 0. They provide numeric information such as the number of a specific note which is to be turned on as a result of a previously sent status byte which set up the command.

"Channel Voice Messages" includes the list of associated status-data byte combinations specified for the following instrument controls in the MIDI specifications: Note Off; Note On; Polyphonic Key pressure (Aftertouch); Control Change; Program Change; Channel Pressure (Aftertouch); and Pitch Bend Change.

A "MIDI Note-On" message refers to a Channel Voice Message associated with playing a particular note on a MIDI instrument or equipment. Its message sequence structure consists of, first, the binary status bits 1001nnnn, where nnnn denotes the voice channel number, and next two data bytes in the form 0kkkkkkk and 0vvvvvvv, wherein kkkkkkk is note number and vvvvvvv is key velocity.

"Channel Mode Messages" refer to a subset of the Control Change messages, being differentiated by the first data byte value. Such messages use the status byte in the form 1011nnnn followed by two data bytes. They are used to select a channel mode from the variety of channel modes available in MIDI systems.

"System Messages" include the status and data byte combinations specified as System Exclusive Messages, System Common Messages and System Real Time Messages. Furthermore, System Exclusive Messages normally are only understood by a particular manufacturer's device. The transceiver in this invention can act upon other manufacturer's System Exclusive Messages as well as its own. They are delineated by a sequence of status, data and "end of exclusive message" bytes wherein bits 4–7 of the status byte are "1111", and the remaining bits determine the type of system message initiated. Data bytes are enclosed between the starting System Message and the End Of Exclusive Message and always have an MSB of zero. If the system message is a System Exclusive Message, the first three bytes to follow the initiation of this message are the manufacturer ID number, followed by additional data bytes which determine the function to be called for.

"Manufacturer I.D." refers formerly to the first byte of data following the System Exclusive status byte.

After more than 124 different manufacturers were discovered they opted to double the length of this identifier to two bytes. It actually turned out to be three bytes long because the first data byte has to be a zero before the system can look for a two-byte manufacturing I.D. following it, otherwise the first byte is determined to mean one of the first 124 manufacturers of MIDI devices whose IDs consist of only a single byte: none of them was allowed to use an ID of zero for this possibility of future expansion. The IMA also reserved three numbers at the top of this range of data bytes (125, 126, and 127) for other uses.

"System Common Messages" refer to messages understood by all MIDI devices irrespective of manufacturer.

"System Real Time Messages" refer to status messages describing timing.

"Microcontroller" refers to any circuit capable of producing the desired action of a microcontroller. A microprocessor is the intelligent portion of a microcontroller and is accompanied by the support circuits which make it a microcontroller, capable of interacting with the outside world of peripherals. A microprocessor having external components (for access to peripherals) that carry out the functions of a microcontroller can be taken as a whole to be considered a microcontroller. Use of either form of this device in this application does not preclude use of the other to provide the services called for and any reference to a microprocessor can be assumed to mean the portion of a microcontroller (as a single unit or as a collection of resources) responsible for making decisions.

The System

Figure 1:
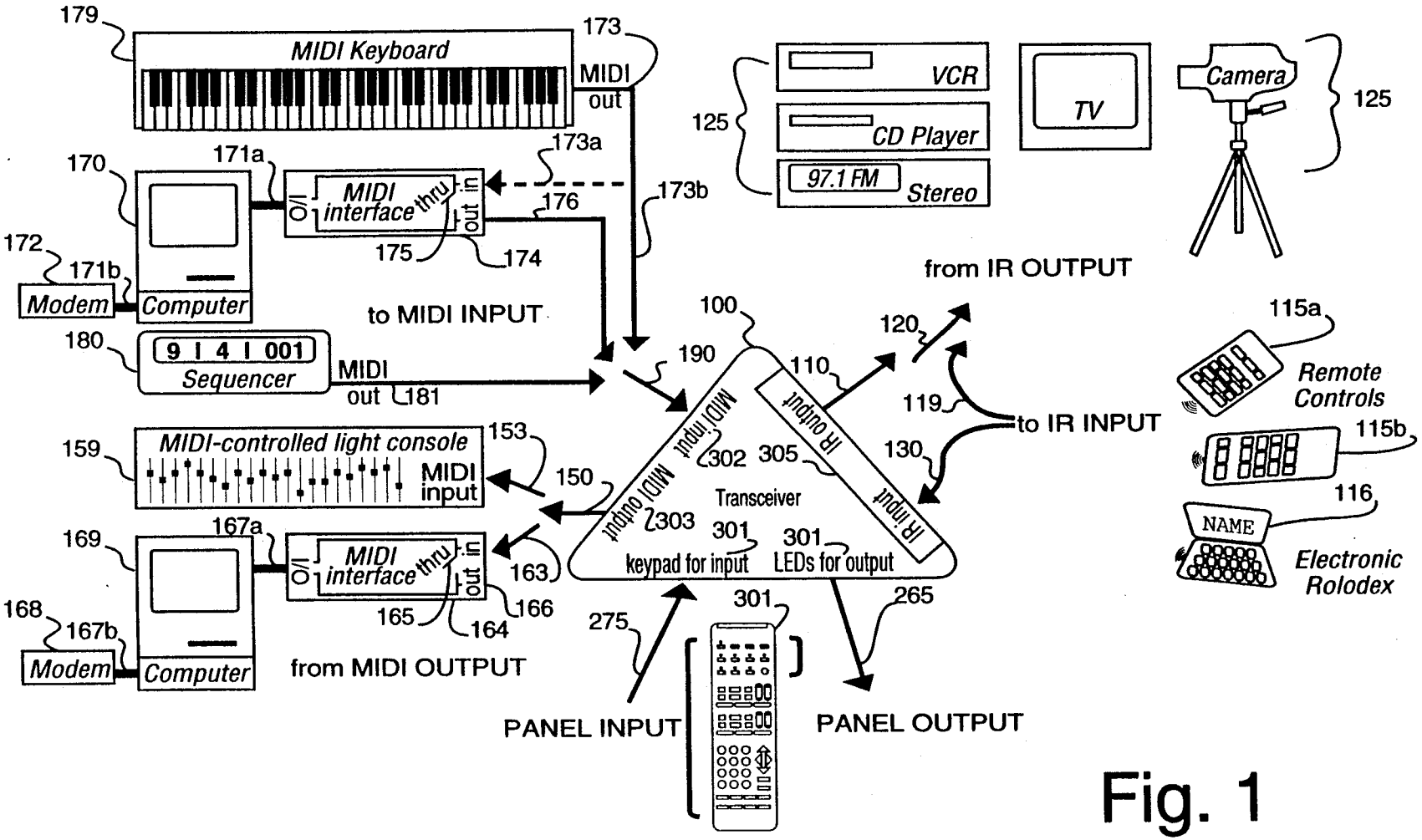
FIG. 1 represents an IR-MIDI transceiver in a functional and operational configuration with other equipment.

As indicated in FIG. 1, communication to (and control of) the IR and MIDI domains can be achieved via use of transceiver diagram numerically illustrated as 100 which possesses the ability to invoke previously received and stored MIDI messages and/or IR messages, and/or to translate between signals of the MIDI and IR domains.

The transceiver 100 contained within a unit 300 can control IR devices 125 in a similar manner that remote controls 115*a* or 115*b* control IR devices 125 along path 119 through path 120 (being either atmosphere or other optical transmission medium). The transceiver 100 can control the IR devices 125 through invisible path 110 and subsequently through path 120 which is any light-transporting medium such as the atmosphere or a fiber-optic light cable in response to any of three types of messages: one of the keypad domain and the other two of the MIDI domain. They are:

1. Via a keypad button message from a human being. A TV or CD device 125 is operable in the same manner as an IR remote control 115*a* or 115*b* by depressing keys on a remote keypad.

2. Via the transception of a valid MIDI message into the IR domain. The MIDI message is supplied to the microprocessor which looks for a matching message among a list of possible messages. The matching message has been previously assigned to an associated infrared output signal. In this case, there is no inherent correlation between the supplied MIDI message and the resulting infrared output signal other than through means of a lookup table (selected from many lookup tables, each of which is defined and determined by the user.) The transmission of IR messages from IR output window 305 if unit 300 travel in space along invisible path 110 and subsequently through path 120 which is any light-transporting medium such as the atmosphere or a fiber-optic light cable. If no match exists, nothing happens and the transceiver 100 continues to look for the next valid MIDI message.

3. Via the transformation of a MIDI message into the appropriate stream of Infrared output pulses. The MIDI message takes the form of a System Exclusive Command which tells the transceiver that it needs to execute a transformation using the data bytes which follow it. These data bytes describe the infrared output such that when the microprocessor (through internal or external program means) transforms the MIDI message, an appropriate stream of infrared pulses is generated. The transmission of IR messages from IR output window 305 travel in space along invisible path 110 and subsequently through path 120 which is any light-transporting medium such as the atmosphere or a fiber-optic light cable.

MIDI signals which activate the transceiver into action can be generated from such devices as a MIDI-compatible keyboard 179, any computer 170 equipped with a MIDI interface 174 or a dedicated MIDI sequencer 180. MIDI signals can be supplied by many varied components and this is by no means a complete list of all of the possible sources of triggering signals. For instance, a computer 170 equipped with modem 172 and MIDI interface 174 could receive information from a database of MIDI and IR data which could be translated as necessary into appropriate IR and MIDI messages to control a determined IR device(s) 125, or MIDI device(s) 159 or computer 169 through use of MIDI interface 164. Two such systems could be connected via a standard phone line between modems 168 (connected to computer 169 through 2-way cable 167*b*) and 172 (connected to computer 170 through 2-way cable 171*b*) and allow for remote control of devices at one location from a controller interconnected to the computer at another location. A MIDI-compatible synthesizer keyboard 179 can also be routed through a MIDI interface interconnected to a computer such that the computer provides an additional level of MIDI signal alteration to produce the final MIDI message responsible for triggering an associated IR message. This additional processing is said to be "interactive". Many MIDI interfaces are also equipped with a "thru" button which allows the MIDI signal from the MIDI-compatible synthesizer keyboard to pass unaltered through the MIDI interface such that it appears to be directly connected to the transceiver 100.

The transceiver can translate IR messages into the MIDI domain in a similar fashion as described for the opposite implementation of translating MIDI messages into the IR domain. The resulting MIDI messages emanating from MIDI output 303 travel along cable 150 to cable 163, to MIDI interface 164, through MIDI thrugate 165 to any components attached to MIDI interface output 166. The transceiver can control MIDI devices 159 or 169 in 3 ways in response to either of two types of messages: one of the KEYPAD domain and the other two of the IR domain.

1. Via a KEYPAD button message from a human being. A MIDI device is operable in the same manner as any MIDI controller which has keys or controller means that trigger MIDI events.

2a. Upon presentation of an IR signal to the transceiver's IR input, the device first attempts to transceive the signal via use of a selected lookup table. If a match exists, then the associated MIDI command is transmitted from the MIDI output of the transceiver. System Exclusive commands are available which allow the user to prioritize the preferred method of translation described in 2*a* and 2*b*.

2b. If a match does not exist then the transceiver transforms the signal into the bits of data which describe the IR signal as periods of on and off times. This information is formatted for transmission over MIDI cables as a proprietary System Exclusive Message. System Exclusive commands are available which allow the user to prioritize the preferred method of translation described in 2a and 2b.

The transceiver 100 is connected with MIDI cables 153, 150 to a MIDI-compatible device 159 such as a MIDI-controlled light console. The transceiver 100 can also be connected with cables 150 and 163 with a MIDI interface 164. The interface 164 is in turn connected with a compatible computer 169. This configuration requires cable connections 150, 163 between transceiver 100 and MIDI interface 164, and cable connection 167*a* between the computer 169 and MIDI interface 164. These connections provide for the transceiver's control of these devices through use of MIDI messages transmitted to their respective inputs 153 (for the light console) or 163 (for the computer interconnected to the MIDI interface).

The IR devices 125 and MIDI devices 159, 165, 175, and 179 can be configured in any combination of IR devices 125 and MIDI devices 159, 165, 175, and 179. The MIDI interface 164 requires computer 169. MIDI provides many mechanisms for isolating specific MIDI devices (including a computer interconnected to a MIDI interface) and communicating between them. IR messages have a signature which inherently isolates and specifies one IR device over another.

Additionally, System Exclusive Commands are also recognized by the transceiver to enable and disable the two communication methods used to communicate signals between the IR and MIDI domains. This allows the transceiver to prioritize the translation method for transformations (as opposed to transceptions) such that they will occur immediately instead of having to first check for a match within a lookup table. This provides for a more consistent timing of the transformation of an IR signal into a MIDI signal by bypassing the time-consuming lookup table stage and proceeding directly to the transforming method of communication between the two domains.

The Transceiver

Figure 2:
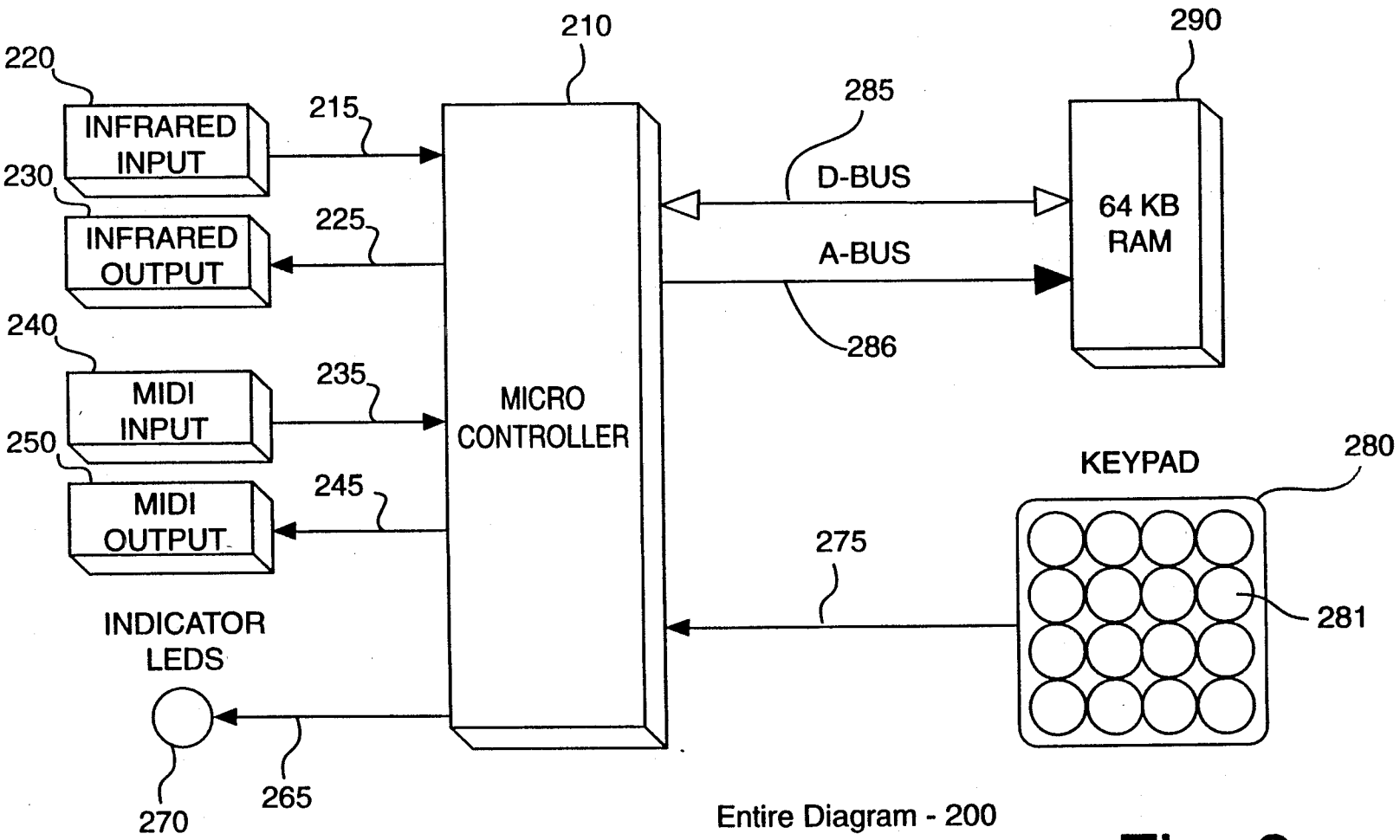
FIG. 2 is a block diagram of the different functional parts of a remote control transceiver.

FIG. 2, the transceiver 300 indicated in detail by block 200, includes circuits 220 and 230 for inputting and outputting IR signals, respectively. These circuits 220 and 230 are connected along lines 215 and 225 respectively, to the microcontroller 210, having a microprocessor 211. Data is transferred both from the IR input circuit 220 to the microcontroller 210 and from the microcontroller 210 to the IR output circuit 230.

Additionally, there are two circuits 240 and 250 for receiving and sending MIDI signals called the MIDI input circuit and the MIDI output circuit, respectively. These circuits are connected along lines 235 and 245, respectively, to the microcontroller 210. Data is transferred both from the MIDI input circuit 240 to the microcontroller 210 and from the microcontroller 210 to the MIDI output circuit 250.

An external memory circuit consisting of RAM chips 290 can store up to 64- Kilobytes (32K ×2 chips ×8 bits). This external memory 290 is connected to the microcontroller via two-way data-bus 285 and one-way address bus 286.

Keypad circuit 280 for the microcontroller 210 provides for any available functions in any combination including direct signalling, changing modes, "learning" and indicating may selectively be included on the transceiver 200. The keypad circuit 280, consisting of any number of keys 281 is connected to the microcontroller 210 via the two-way connection 275 from keypad 280 to microcontroller 210. Through this connection 275 row and column data is transferred to and from keypad 280 to and from the microcontroller 210. As illustrated in FIG. 2, the keypad 280 shows 16 such keys implemented.

Indicator circuit 270 for the microcontroller 210 provides for any visible indications of actions carried out by the transceiver 200. Indicator circuit 270 is connected to the microcontroller 210 via one-way data-bus connection 265 from microcontroller 210 to Indicator circuit 270.

Figure 3:
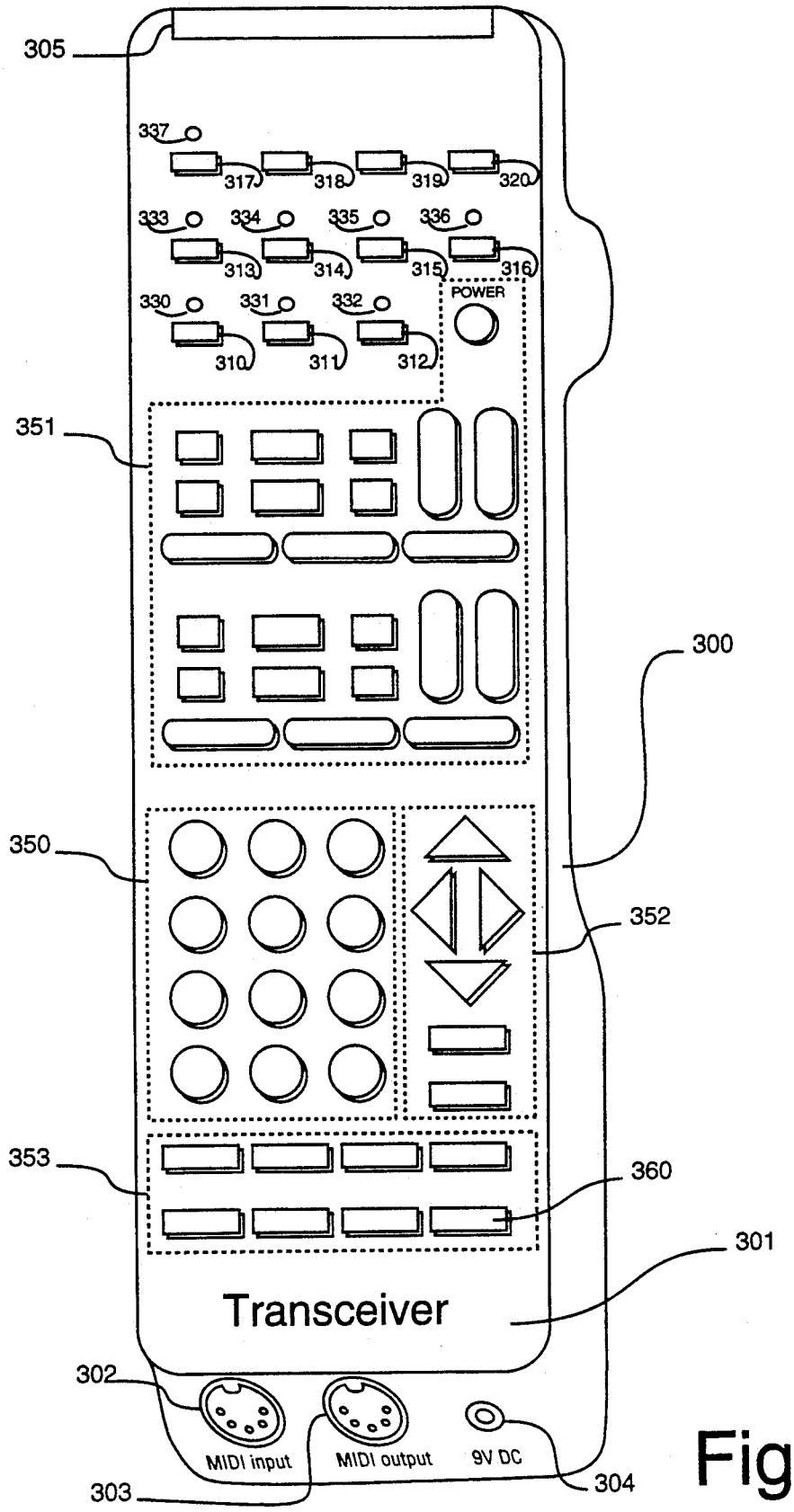
FIG. 3 is a view of the transceiver with keypad illustrated.

As shown in FIG. 3, the transceiver 300 is equipped with the keypad device 301 on the top surface of the unit 300. The keypad 301 is capable of sending a matrix location, specified by row and column, to the microprocessor 211 of the microcontroller 210 (as shown in FIG. 2). This sends a preset message upon the depression of a selected key 360. The keypad 301, as illustrated in FIG. 3, is capable of accommodating sixty-four keys 360. Thus there is space and connections for sixty-four keys or buttons.

An illustrative operation of keys 360 of keypad 301 of FIG. 3 is described.

Key 317 is labelled "TEACH." When pressed, it illuminates LED 337 and enters the "Teach" mode. This is a mode whereby, based upon previously set up "Watch Methods," the transceiver begins watching for a message within a preset time duration from any domain. As soon as a first message is received, an LED 330, 331, or 332 lights up based on the domain of the message (IR, MIDI, or KEYPAD, respectively). All that remains is to trigger a second message from either of the two remaining domains and the corresponding LED 330, 331, or 332 will light briefly and then all LEDs 337, 330, 331, and 332 will turn off. A two-way transception program has now been taught to the transceiver. Either message input to the transceiver will now trigger the associated message from the other domain. If this procedure is repeated and another transception program is created utilizing one of the two messages from the previous example, a three-way transception program can be taught to the transceiver. By repeating one of the messages from the first example and associating it with a third message from the third (as yet unaccessed) domain, a three-way transception program is established whereby a message in any domain will trigger messages in the other two domains. The keypad responds to messages by flashing the proper LED 330, 331, or 332 to indicate the source and destinations of the messages entering and leaving the transceiver device. LEDs 333, 334, 335, or 336 also flash depending upon which Program Map is being used of the 8 possible choices from TV1, TV2, AUDIO1, AUDIO2, VIDEO1, VIDEO2, AUX1, or AUX2.

Key 318 is labelled "WATCH METHOD." When pressed, it illuminates LED 337 and enters a different kind of "Teach" mode. This allows the user to set up different ways of watching for data in each domain in specialized ways. After entering "WATCH METHOD" teach mode, the next pressed button 310, 311, or 312 will indicate the domain for which we wish to change the "WATCH METHOD." For IR, the choices relate to determining its communication method (either a transformation or a transception). For MIDI, it specifies which of a series of preprogrammed algorithms is to be used for detecting matching parameters of MIDI messages. For example, one algorithm might specify that a Note-ON message trigger a look for a Note-Number of 108, and another algorithm might be more interested in the fact that any note was played with a velocity of over 120. In the first case, the algorithm triggers on a status byte #1 (the Note-ON status byte) and then data byte #2 (the Note-Number). The second algorithm triggers on the same Note-ON message by matching byte #1 but has no reference to byte #2 (the Note-Number) but does have a reference to byte #3 (the Velocity).

The format for a MIDI-Input Domain Algorithm Message (MIDAM) is as follows:

Algorithm Message length =2+2X bytes where X=the number of additional tests (up to 15) required (beyond the first test) for a matching MIDI message input to trigger an associated IR output. A test consists of a comparison between two single-byte values. The values are indicated by pointers in the MIDAM. The only exception to this length description is when a pointer byte needs to reference a position beyond the fifteen available pointer destinations in a basic MIDAM. In this case an extension byte immediately follows the pointer to increase its pointing range to a maximum of 255 positions. (Only the lower nibble of each byte is used to determine the pointer.) A MIDAM might consist of:

| Byte # | Value | Description |
|---|---|---|
| | Map of a MIDAM (Byte-level) | |
| 1 | 1001xxxx | Note-ON event status message |
| 2 | 00000001 | 1 additional message to check |
| 3 | 00000011 | check 3rd byte of input MIDI data |
| 4 | 00000000 | Zero (place holder, to be filled with data when a MIDPM is created) |
| | Map of a MIDAM (Bit-level) | |
| 1 | ALL | First byte to match before proceeding with the rest of the algorithm |
| 1 | 0–3 | channel (determined by transceiver) except when bits 4–7 = "1111" |
| 1 | 4–7 | 1000–1110 = Channel Voice Messages to match |
| 1 | 4–7 | 1111 = System messages + bits 0–3 represent specific commands |
| 2 | ALL | # of additional tests required to pass this algorithm and which layers to use once a match is achieved. |
| 2 | 0–3 | 0001–1111 = the number of additional tests to be checked |
| 2 | 4 | 0 = goto "Button Down" layer<br>1 = suppress "Button Down" layer |

-continued

| Byte # | Value | Description |
|---|---|---|
| 2 | 5 | 0 = goto "Button Still Down" layer<br>1 = suppress "Button Still Down" layer |
| 2 | 6 | 0 = goto "Button Up" layer<br>1 = suppress "Button Up" layer |
| 2 | 7 | 0 = high-bit always 0 |
| 3 | ALL | pointer to one byte of the incoming message for this test and a comparison needed for it. The 4th byte is determined when a MIDAM is used to create a MIDPM (MIDI Input Domain Program Message). Once the MIDPM is generated, this byte sets the limit to which the inputs are being compared. (A 2nd pointer would be in the 5th byte of the MIDPM and MIDAM. The 2nd data value for comparison would be in the 6th byte of the MIDPM. A Zero would exist in these positions in a MIDAM) |
| 3 | 0–3 | 0001–1111 = pointer to one of the fifteen possible bytes anywhere along a particular MIDI message's word train (most MIDI messages only take up 2 or 3 bytes but some System Exclusive messages may take up 10 or more bytes to complete a message. This nibble can point to any byte within a 15 byte MIDI message. |
| 3 | 4 | Extend bit - if set to "1" this extends the length of the comparison pointer by 4 bits. It causes the system to load an additional byte and place the lower nibble of this byte into the higher nibble of a larger, extended, pointer byte. Indexes which can point to up to 255 different positions can now be created. |
| 3 | 5–6 | "00" target must = comparison<br>"01" target must >= comparison<br>"10" target must <= comparison<br>"11" undefined |
| 3 | 7 | High-bit always 0 |
| 4 | ALL | bits 0–6, = 0 for MIDAM. For a MIDPM, this 7-bit number defines the value of the first comparison byte needed (a 2nd comparison byte, if needed, would end up in byte #6 of the MIDPM). |
| 4 | 7 | High-bit always 0 |

A MIDPM (MIDI Input Domain Program Message) is the result of a MIDAM having been successfully used to capture a sample of targeted MIDI data for association with some other domain's message. This targeted data to be found is called out for specifically in each possible MIDAM used to tell the transceiver which data to watch for (Watch Method key 318). When the transceiver is in "TEACH MODE" (using a particular MIDAM) the first MIDI message which matches the format of the MIDAM gets its data bytes captured by the transceiver and compiled into a MIDPM. This MIDI event will be available to the system for playback as long as it is associated with at least one command of at least one of the two alternate domains (KEYPAD or IR) before the teach cycle runs out of time. If the teach cycle expires before an association is complete, then nothing happens and no previously stored data is disrupted.

The keypad 301 includes two traffic control-like buttons. They are "START SENDING" key 319 and "STOP SENDING" key 320. Their purpose is to control passage of triggering signals at blocks 410, 415, 420, 425, 430, or 440 between domains within the transceiver. The keypad is considered a domain which is directly addressable by humans and can indicate the presence of signals of alternate domains. Infrared and MIDI are the two alternate domains. Communication is initiated between domains by a two or three button sequence beginning with pressing the "START SENDING" key 319.

If the "START SENDING" key 319 is pushed again (before any other button is pushed), this would indicate a global "start sending from all domains to all domains". All passage gates 410, 415, 420, 425, 430, and 440 are open allowing full translation of all messages received. This is a two-button message and no third button press is required.

If the second and third button presses are chosen from the collection of the three domain buttons, then the second button pressed refers to "the domain from which to start sending messages" and the third button pressed refers to "the domain to which communication should begin."

Everything that applies to the "START SENDING" key 319 also applies to the "STOP SENDING" key 320 with the exception that it signals the stopping of communication instead of the starting of it.

Four "Program Map" keys exist on the transceiver. They are TV½ key 313, AUDIO ½ key 314, VIDEO½ key 315, and AUX½ key 316. A single press of any of these keys causes an associated LED 333, 334, 335, or 336 to flash and then changes the program map of commands associated between domains. Two maps are available on each key and the second map is accessed by pressing the key twice (without pressing any other keys before the second press of this key).

Three "Domain Indicator Keys" exist on the transceiver. They are IR key 310, MIDI key 311, and KEYPAD key 312. They provide data to other system related functions which require a domain to be specified as one of the function's parameters. Associated LEDs 330, 331, and 332 flash to indicate the presence of either an input or an output signal occurring in the IR, MIDI, or KEYPAD domains, respectively.

Numeric keys 350 labelled 0 through 9 and non-numeric keys labelled "*" and # are used for such functions as channel control for conventional IR devices 125 like TVs. Numeric keys 350 may also be used to input numeric data for those devices requiring it.

Transport keys 351 control various functions relating to the operation of recording and playing of audio/video devices. Functions such as "Play," "FF," "Stop," "Rewind," "Pause,""Record," "TV/Video," "Display," "Index-," "Index+," "Input," "Scan-," "Scan+," "Antenna," "Volume UP," and "Volume Down" are implemented in the transceiver keypad 301.

Additional keys 352 control additional functions such as "Balance-L," "Balance-R," "Mute," "Enter," "Volume Up," and "Volume Down."

Functions keys 353 provide for user programmable functions.

The transceiver 100 is equipped with an input receptacle 302 as well as an output receptacle 303 for cable connection to one or more MIDI devices 159, 165, 175, and 179. These connections meet the standard MIDI specifications. The IR signal is transmitted and received from input/output face 305 by signalling through the air. Power to the transceiver is provided by a generic power supply (local to any specific region of the world) connected to the 9-volt power jack 304.

Additionally, there is the added capability of triggering signals by signals themselves rather than by pressing keys or buttons. With certain keys programmed to control MIDI functions of devices 159, 165, 175, and 179 and certain keys programmed to control IR functions of devices 125, a conventional remote control 115*a* or 115*b* may be unnecessary: the overall control of both domains is integrated into the transceiver 100.

Software And System Flow Chart

The high-level flow of the system software hardwired onto microprocessor 7101 is described by the flow chart of FIG. 5. The more detailed lower level system flow is shown in FIGS. 6*a* and 6*b*. The flow closely parallels that of FIG. 5. The system responds to three basic types of events, and takes the corresponding path depending on the type of event it is responding to. Before any response can be made, the system tables are initialized.

Initialization and Setup of Tables

Before the system is operative to start processing any key message or incoming message, all variables and data tables are defined. Information that is variable includes such things as information for timers, delay loops, locations, and hardware information.

Tables for IR codes and MIDI codes will be structured in an index form such that one sequence of codes in either the IR or MIDI domain can trigger the performance of one or more sequences of codes in the IR or MIDI domain. Default tables can be supplied but preferably the tables may be user-programmed. A user may input data into the data tables by way of an independent computer.

Processing begins with initialization of the special function registers (SFRs) and memory pointers. A special function register is associated with each port on the hardware since each input and output port has alternate functions. Memory pointers are used for indirect addressing, such that an address can point the location to where performance information resides. After initialization, the program jumps to the start routine 502 and will begin a loop of checking for any of 3 initial types of events. They are: Button Depressed block 503, MIDI data received block 527, and IR code received block 556. This checking loop happens indefinitely until a message of one of these types is received.

Key Depressed Processing

1. Lookup Key Table Process:

If a key 360 on keypad 301 is depressed as indicated in 503. Depending upon previously pressed keys, the transceiver 300 may be operative to allow the recording of new messages to be associated with a key 360 and stored in key-lookup table 501.

2. Message Sending Process

Should it be determined that a message is to be sent, the domain of the message to be sent is determined according to the key table 501. If an IR message is to be sent by 504, the IR code is selected, and the pulse width is set according to table 501 which sets the particular pulse width for an IR transmission based upon the message to be sent along with other parameters that influence its transmission and the IR is sent by 504*a*. Should a MIDI message be sent by 505*a*, a MIDI code is selected by the table 501 and a MIDI message 505*a* is sent.

3. Teach Mode Invoked

When "Teach" key 317 is depressed, a teach sequence 506 is invoked. The teach LED 337 illuminates to indicate this. Two messages from alternate domains are now to be supplied to the transceiver 300 within a certain fixed period of time (or until the user exits the mode by pressing "teach" key) after which this mode is terminated and control returns to normal operation. The first message can be from any of the three domains (Keypad, MIDI, or IR). A message of any domain received is indicated by illumination of the proper LED 330, 331, or 332 associated with the domain of the message received. The second message must come from either of the two remaining domains and will be indicated with LED 330, 331, or 332 in a similar manner. This sets up an association between the two messages such that an input to transceiver 300 of either of these messages results in the transmission of the corresponding message in the alternate domain to be sent in its stead. If this teaching procedure is repeated, and the first of the associated messages is the same as one of the messages from the first example, then a three-way association can be achieved by assigning a command from the (as yet) unaccessed third domain. An input to transceiver 300 of any of these messages now results in corresponding messages in both of the alternate domains to be sent. (The keypad responds to messages by illuminating indicator LED 330, 331, and/or 332.

4. Map Changing Process (Keys 333, 334, 335, or 336)

Maps of associated commands can be changed upon the alternate selection of one of the "Program Map" keys 333, 334, 335, or 336 on the keypad 301. Program Map selection (choosing which tables of commands are to be utilized for transception of messages between domains) can be made by pressing one of keys 333, 334, 335, or 336 to indicate Program Maps associated with TV½, AUDIO½, VIDEO½, or AUX½, respectively.

a. TV ½ Map

If the TV ½ key 313 is pressed once, it selects a map of associated commands related to the functions of TV1. If this key is pressed twice, it selects a map of associated commands related to the functions of TV2.

b. AUDIO ½ Map

If the AUDIO ½ key 314 is pressed once, it selects a map of associated commands related to the functions of AUDIO set 1. If this key is pressed twice, it selects a map of associated commands related to the functions of AUDIO set 2.

c. VIDEO ½ Map

If the VIDEO ½ key 315 is pressed once, it selects a map of associated commands related to the functions of VIDEO set 1. If this key is pressed twice, it selects a map of associated commands related to the functions of VIDEO set 2.

d. AUX ½ Map

If the AUX ½ key 316 is pressed once, it selects a map of associated commands related to the functions of AUX set 1. If this key is pressed twice, it selects a map of associated commands related to the functions of AUX set 2.

MIDI Message Processing

Should a MIDI message be received 527, the software in table 501 determines whether or not the MIDI data is "valid." If the request is to send a MIDI message 529, then MIDI data is selected and sent 529*a*. If the request is to send an IR message 528, then IR data is selected and sent 528*a* to IR devices 125. If the request is to receive a "SYSEX" message 530, then the software table 501 checks whether a valid ID and device was sent with the request. The "SYSEX" message is then stored 513. If request is to send or dump a SYSEX message 531, then the ID and device is further checked for validity, and then sent 531*a*.

IR Received Processing

Should an IR message be received 556, the software begins an IR detection/identification algorithm. It does this by sampling the IR signal at a sampling rate which is 10 to 20 times faster than the expected rate of data pulses to be captured. The samples evaluate to "1" in periods of time when the IR LED from a remote 115*a* or 115*b* is on and evaluate to "0" during periods of time when it is off. These strings of on and off samples (taken collectively) represent the various pulse widths needed to express an IR message and are compressed by the software in the microcontroller into a format for comparison to known, previously programmed IR messages. Software table 501 determines whether IR data is valid. If valid, and the request is to send IR data 557, IR data is selected and sent 557*a*. If valid, and the request is to send MIDI data 558, MIDI data is selected and sent 558*a*. If valid, and the request is to send MIDI System Exclusive data 559, MIDI System Exclusive Data is selected and sent 559*a*.

Software And System Flow Chart

The detail flow diagrams illustrated in FIGS. 6*a* and 6*b* are now described.

With reference to FIG. 6*a*, there is shown the start sequence. The variable IR codes and MIDI set up tables are defined as indicated in block 501. Thereafter the special function registers and memory pointers are initialized as indicated in block 601. At this point, the transceiver 100 is scanning its inputs for signals sent to it.

A key is depressed as indicated in block 503. Thereupon the lookup key table 602 is activated to determine whether or not and IR message needs to be sent. If an IR message is to be sent, then the code is determined from the lookup table as indicated in block 603, followed by the setup of the necessary pulse widths in block 604 to properly transmit the message which is then sent in block 504*a*. Processing continues to block 505 (whether an IR message is sent or not.) Should a MIDI message be sent 505, the MIDI data 605 is selected and the MIDI signal 505*a* is sent.

Operating the keyed 301 can initiate a teach sequence 506*a*. At block 506, if it is determined that the teach sequence 506*a* is to be operative, a teach LED 606 is activated. The sequence to teach is either whether an IR message is received 607 or a MIDI message is received 608 or whether a key is depressed 609.

If an IR message has been received, this IR signal 610 is stored. IR LED 611 is activated and a determination is made whether the MIDI is received, 612. If yes, the MIDI is assigned, 613, which then cycles back along line 613*a* to the line 699 back to the main event loop beginning with the key depressed block, 503. If the MIDI is not received in block 612, the determination is made in 616 as to whether a key is depressed. If yes, the key is assigned, 617, and then cycles back along line 613*a* to the line 699 back to the main event loop beginning with the key depressed block, 503. If the key is not depressed, the question is asked whether the time is up at 618. If yes, the system then cycles back along line 699 back to the main event loop beginning with the key depressed block, 503. If time is not up, then processing continues along line 618*a*, the system recycles to MIDI Received block 612 to continue checking for any associated message desired (either MIDI or KEYPAD).

Similarly, with the teach cycle moving on to the next possible first-associated event block 608, there is provided a block 620 for storing a MIDI event (should one occur) which results in the MIDI LED 621 responding. Subsequently, a determination is made as to whether any IR is received, 622, and assigned, 623 and the system then cycles back along line 623*a* to line 699 back to the main event loop beginning with the key depressed block, 503. If not, a determination 624 is made as to whether a key is depressed 624 and the key is assigned, 625 and the system then cycles back along line 623*a* to line 699 back to the main event loop beginning with the key depressed block, 503. If not, a determination is made as to whether the time is up, 626. If yes, the system then cycles back along line 699 back to the main event loop beginning with the key depressed block, 503. If time is not up, then processing continues along line 626*a*, the system recycles to IR Received block 622 to continue checking for any associated message desired (either IR or KEYPAD).

Continuing, the teach cycle moves on to the last possible first-associated event block 609 (key depressed). There is provided a block 628 for storing a KEYPAD event (should one occur) which results in the KEYPAD LED 629 responding. Subsequently, a determination is made as to whether any IR is received, 630, and assigned, 631 and the system then cycles back along line 631*a* to line 699 back to the main event loop beginning with the key depressed block, 503. If not, a determination 632 is made as to whether a MIDI event is received 632 and the MIDI event is assigned, 633 and the system then cycles back along line 631*a* to line 699 back to the main event loop beginning with the key depressed block, 503. If not, a determination is made as to whether the time is up, 634. If yes, the system then cycles back along line 699 back to the main event loop beginning with the key depressed block, 503. If time is not up, then processing continues along line 634*a*, and the system recycles to IR Received block 630 to continue checking for any associated message desired (either IR or MIDI). If none of these three events occurs within this loop, a determination is made at block 636 as to whether or not the time to complete this function is up. If not, processing proceeds back to the top of the loop at block 607, continuing the search for a first-associated event. If the time is up, then processing proceeds along line 636*a* to line 699 back to the main event loop beginning with the key depressed block, 503, effectively completing the teach mode key-depressed processing.

If no teach mode is invoked, then processing continues beyond "Teach" block 506 along line 698 to the section of code dealing with "Program Map" selection. This begins with the VIDEO ½ page key pressed block 640. If the VIDEO ½ key 315 is pressed once, it selects a map of associated commands related to the functions of VIDEO set 1 in block 643. If this key is pressed twice (block 641), it selects a map of associated commands related to the functions of VIDEO set 2 in block 642. Thereafter, the question is determined as to whether the TV ½ mode is depressed 644. If pressed once, it sets TV 1 mode 647. Otherwise, if it is pressed twice (block 645), then the TV 2 page of associated commands 646 is selected. Similarly, the question is asked whether the AUDIO ½ mode key 648 is depressed and if pressed twice 649, this sets AUDIO 2 mode 650. If not pressed twice, it sets AUDIO 1 mode 651. Finally, it is determined by default that the AUX ½ mode 652 has been depressed and if pressed twice 653, the AUX 2 mode 654 is operated. If not pressed twice, the AUX 1 mode 655 is operated. Having completed any of the previous scenarios, processing continues along line 642*a* to line 699 back to the main event loop beginning with the key depressed block, 503, effectively completing *all* key-depressed processing.

Processing continues in the main event loop along line 697 looking for the next possible event upon which to take action. The question is asked whether any MIDI data is received, 527. If yes, the validity of the MIDI data is determined 660, and, if valid, a corresponding pointer is determined at transceive block 662. Assuming that MIDI to IR transceptions have been enabled at 528, then appropriate IR data is selected 657 using the pointer previously determined at block 662 for selecting IR data at block 667 whereupon the message is transmitted at block 528*a*. Processing would then continue to line 699 back to the main event loop beginning with the key depressed block, 503. If the data was not valid at block 660 then the question is asked if the MIDI data was formatted for a transformation at block 661. If yes, then the MIDI data is transformed into an appropriate stream of IR pulses and transferred along line 661*b* and assuming that MIDI transformations have been enabled at block 670 then the IR data is transmitted at block 671. In either case, processing continues along line 699 back to the main event loop beginning with the key depressed block, 503. If IR messages are not to be sent from block 528 and transformations are not enabled at block 661, then the MIDI data is transferred along line 661*a* to block 530 and the question is then determined whether a SYSEX message 530 is to be activated for receiving data or a SYSEX message 531 is to be activated for transmitting data. In both cases, appropriate verifications 658 and 659 respectively are performed before subsequent reception or function request 530*a* or transmission 531*a* of MIDI data is carried out. Whether or not any Sysex commands were carried out, processing continues along line 699 back to the main event loop beginning with the key depressed block, 503.

Processing continues in the main event loop along line 697 looking for the next possible event upon which to take action. The question is asked whether the IR data is received, 556. If yes, the validity of the IR data is determined 680, and, if valid, a corresponding pointer is determined at transceive block 682. Assuming that IR to MIDI transceptions have been enabled at 683, then appropriate MIDI data is selected using the pointer previously determined at block 682 for selecting MIDI data at block 684 whereupon the message is transmitted at block 685. Processing would then continue to line 699 back to the main event loop beginning with the key depressed block, 503. If the data was not valid at block 660 then the question is asked if the MIDI data was formatted for a transformation at block 681. If yes, then the IR data is transformed into an appropriate MIDI message and assuming that IR to MIDI transformations have been enabled then the MIDI data is transmitted at block 685. In either case, processing continues along line 699 back to the main event loop beginning with the key depressed block, 503. This also complete the entire main event loop and if no IR message is received then processing continues along line 699 back to the top of this loop beginning with the key depressed block, 503.

Electronics Of Transceiver

Each section of the schematic circuit of FIGS. *7a* and *7b* for receiving signals, transforming signals, converting signals, and for signalling IR devices and MIDI devices is described.

The transceiver 100 illustrated as circuit 7000 comprises nine major electronic sections. These are i) IR Input circuit 7200; ii) IR Output circuit 7300; iii) MIDI Input circuit 7400; iv) MIDI Output circuit 7500; v) microcontroller 7100; vi) Clock and Reset circuit 7600; vii) external memory 7900 including a chip for buffer 7910 and a RAM chips 7920, 7921 for temporary data memory and external ROM chip 7930 for external microprocessor program means; viii) keypad 7800; and ix) indicator LEDs circuit 7700.

As shown in FIGS. *7a* and *7b*, the transceiver 7000 includes means 7200 for receiving IR signals or messages through an IR input device 7200. The signals are not received by hard wiring but through space. The medium of transmission can also be fiber-optic cable when transmissions need pin-point directional accuracy. The transceiver 7000 processes the IR signals in a microprocessor chip 7101 of the microcontroller 7100. The transceiver 7000 also includes means for receiving cables for MIDI messages through a MIDI input device 7400.

The microcontroller 7100 includes a memory means for storing converted messages in a RAM (random access memory) unit 7900 for further processing in the microprocessor chip 7101, which is a CMOS single-chip 8 bit device.

Output from the microcontroller 7100 can be MIDI or IR data. Transmission is from an IR output transmitter 7300 or a MIDI output device 7500.

The microcontroller 7100 includes the microprocessor chip 7101 which is a programmed hardwired system. This includes translating means to change message bits from IR-domain to MIDI-domain and from MIDI-domain to IR-domain according to method depicted in FIG. 5 and FIGS. *6a* and *6b*, with lookup table procedures detailed in Tables 1a, 1b, 2a, 2b, 3a, and 3b.

The transceiver 7000 includes means for directly signaling IR devices 125 or MIDI devices 159, 165, 175, and 179 from a keypad device 301. Preset or programmable keypad keys 7800/360 on the keypad 301 provide means for selecting modes.

Apart from the transceiver 100, an application software program resides in a computer 169 or 170. This computer 169 or 170 and the application program provides for intelligently interpreting commands from the transceiver 100 or from MIDI device 179. This enables a more complex interaction between the MIDI devices 159, 165, 175, and 179 and IR devices 125.

The transceiver 7000 is clocked and reset utilizing the "Clock and Reset Circuit" 7600 and is reset upon powering up.

Hardware

IR Input/Output Circuits 7200 and 7300

The transceiver 7000 includes an IR receiver circuit 7200 and an IR transmitter circuit 7300.

The IR input circuit 7200, establishes required means for receiving and converting IR signals received through a photovoltaic transducer 7200-U1 into required electrical signals consisting of on and off pulses which are sent to the microcontroller 7100 so as to enable the IR signal's transformation or transception into MIDI signals. The IR input section 7200 has the capability of transferring converted electrical IR-domain signals into the microcontroller 7100 through buffer 7200-U2 and are sent as a voltage to external input port IR-IN of the microprocessor 7101. The signals are processed according to the system illustrated and described in FIG. 5.

The IR transmitter circuit section 7300 establishes the required means for signalling IR devices 125 in required conformity with the microcontroller 7100. Such signals are signals processed by the microprocessor 7101. IR output section 7300 is driven from an external output port IR-OUT of the microprocessor 7101. The IR signals are generated in response to the electric signals at port IR-OUT. This triggers a transistor 7300-Q1 tied to ground through resistor 7300-R1 to pass current on to timer integrated circuit 7300-U1 supported by resisters 7300-R3, 7300-R4, 7300-R5, 7300-R6, variable resistor 7300-VR1, and capacitors 7300-C1, 7300-C2, 7300-C3, 7300-C4. The output of this circuit travels through resistors 7300-R7 and 7300-R8, to transistors 7300-Q2 and 7300-Q3, and then to IR output LEDs 7300-D1 and 7300-D2, shunted by resistors 7300-R9 and 7300-R10, respectively.

MIDI Input/Output Circuits 7400 and 7500

There are two circuits which handle the MIDI communication needs of the transceiver which are the MIDI input circuit section 7400 and the MIDI output circuit section 7500. MIDI input/output circuits 7400 and 7500 are used for transferring electrical MIDI signals into and out of the microcontroller 7100 and into and from MIDI devices 159, 165, 175, and 179 or the MIDI interface 174/164.

MIDI input section 7400 for receiving MIDI signals at the MIDI input enables their conversion and transportation into the microcontroller 7100 at input port MIDI-IN. MIDI input circuit 7400 receives encoded signals through the standard MIDI specification input connector 7400-J1. This is a five pin female panel mounted receptacle, wherein pins 1, 2, and 3 are left unused. This receptacle 7400-J1 connects at 302 on the surface of the transceiver 300 to standard MIDI cables connected to the MIDI device 179, MIDI interface 174, or Sequencer 180.

Information via MIDI cables is sent at a rate of 10 bits per 320 microseconds over a 5 mA (milli ampere) current loop (requiring less than 5 mA to turn on) and logical 0 is set for current on. The first bit is a start bit, the next 8 bits are data bits (labeled D0 through D7) and bit 10 is the stop bit. First, a status byte is sent, followed by the required number of data bytes under the specification.

The MIDI input circuit 7400 is further completed by resistor 7400-R1 of 220 ohms, followed by diode 7400-D1. An "opto-isolator" 7400-Ul prevents ground loops. Resistor 7400-R2 follows the "opto-isolator." The circuit continues through buffer 7400-U2 and connects at port MIDI-IN, an 8-bit serial input port, for connection to the microprocessor chip 7101.

The MIDI transmitting circuit section 7500 for signalling MIDI device 159 or computer 169 interconnected through cable 167*a* to MIDI interface 164 with converted signals includes an output circuit connected to the microprocessor 7101 at port MIDI-OUT. This circuit section 7500 respectively consists of resistor 7500-R1 and 7500-R2 of 220 ohms, and buffer integrated circuit 7500-U2. The output connection is standard to MIDI specification. It contains a five pin mount receptacle, of which pin 4 and 5 are connected and of which pin 2 is grounded. The transistor receptacle 303 is on the transceiver 300 as a connection for MIDI cables. Signals are sent through the cables from the receptacle 303 to the MIDI devices such as light console 159 or computer 169.

Microcontroller Section (7100)

The microcontroller 7100 is the main microprocessor of messages and directs the inputting, outputting, buffer storage and RAM storage, and overall processing of received messages. Processing includes the following tasks and purposes: i) the initialization of tables, ii) determination of the source of and type of data received, iii) determination of the validity of the request contained in the message, iv) determination of the type of request or goal to which it is directed, and v) the selection of either MIDI and/or IR data according to the flow charts of FIGS. 5, 6*a* and 6*b*.

The microcontroller 7100 incorporates a microprocessor chip 7101 with systems software and flow for the purposes described. The software is hardwired into the chip 7101 and configured with data input and output ports. The microprocessor 7101 also coordinates the interaction between the software and hardware.

In general, the electronic sections of the transceiver 7000 are allocated the following ports:

- port 7100-IR-IN for IR input;
- port 7100-IR-OUT for IR output;
- port 7100-MIDI-IN for MIDI input;
- port 7100-MIDI-OUT for MIDI output;
- port groups 7100-P1, 7100-P2, 7100-P3, and 7100-P4 for data input and output with storage 7900;
- data port group 7100-P5 for input to keypad circuit 7800; and
- data group 7100-P6 for output from keypad circuit 7800.

RAM/ROM Memory Chips (7920. 7921. 7930)

A MIDI or IR signal is processed in the microprocessor 7101 using internal memory. The final (either transformed or transceived) message to be transmitted is stored by transferring data through the 8 pin bidirectional input/output ports 7100-P1. Port group 7100-P1 contains Address/Data pins marked AD7 through AD0 and are attached to data bus 7901 which connects directly to storage buffer (or latch) chip 7910. Port group 7100-P1 is used both for supplying the lower 8 bits of addresses for stored and retrieved data as well as both the lower and upper 8 bits of data stored or retrieved to or from RAM/ROM chips 7920, 7921, and 7930. Chip 7910 temporarily stores address and data bytes for later use by RAM chips 7920, 7921 and ROM chip 7930.

Buffer or latch 7910 then directly connects through address bus 7902 into RAM chips 7920, 7921 and ROM chip 7930 to enable transfer and storage of data bits after having been temporarily held by buffer 7910. Data bits held in the buffer chip 7910 are transferred by the data bus 7901.

There is an output program pulse 7900-P2 at 1/6 the oscillator frequency from the clock and reset circuit 7600 which activates latching the low address byte during data transfer to memory.

The buffer chip circuit 7910 is further completed by connection to a voltage supply (VCC) and to capacitor 7900-C1 of 0.1 microfarad before grounding. In a similar fashion, the memory chip circuit 7920, 7921 is further completed by connection to a voltage supply (VCC) and to capacitors 7900-C2, 7900-C3 of 0.1 microfarad before grounding.

At the 8 bidirectional input/output pins of port labelled 7900-P3, starting with A8 and ending with A14, data bits determined by the "high address" (or upper 8 bits of the address) are transferred during access to external memory. During program execution, the high-order address bits are received. The "high address" is directed to the RAM memory location 7907 of RAM chips 7920, 7921 through high address bus 7904 which is directly connected and does not loop back around to the microprocessor. Data port group 7900-P4 contains output pin 7900-P4-XMEM (for activating buffer chip 7910), output pin 7900-P4-RD (for external data memory read strobe), and 7900-P4-WR (for external data memory write), and output pins 7900-P4-XRAM0 and 7900-P4-XRAM1 (for enabling the reading from, or writing to external RAM0 or RAM1) and output pin 7900-P4-PSEN (for activating ROM chip 7930), and output pin 7900-P4-XROM0 (for enabling the reading from ROM chip 7930). The pins are connected to these components by seven independent connection lines.

Clock and Reset Circuit (7600)

Clock and Reset Circuit 7600 is connected to the microcontroller 7100 at four points, RST, XTAL1 and XTAL2, and VSS. A quartz crystal 7601 is used as an inverting oscillator amplifier and permits a reset of the clock upon powering-up of the system. When there is a high current on the RST (reset) pin the device is reset. Piezoelectric crystal 7601 is placed between the two capacitors in parallel, capacitor 7600-C1 of 33pF and capacitor 7600-C2 of the same capacity. The circuit from the RST pin is completed by resistor 7600-Rl in series with capacitor 7600-C3. This circuit provides timing pulses to coordinate the various needs of peripherals to the microcontroller.

Keypad-Signaling Circuit 7800

The keypad 7800/301 includes a circuit used for directly sending messages and for enabling a key 7801/360 to learn the key/s of another instrument such that it is programmed to generate that command sequence. Keys 360 on the keypad 301 all initiate commands in the domain set by the mode keys.

Input/Output port group 7100-P5, consisting of pin group ROW0 through ROW7 is to output a successive sequence of pulses along row data lines 7810 from the microprocessor 7100. Input port group 7100-P6 containing port pins COL0 through COL7 is for transferring column data to the microprocessor 7101 as a result of a signal generated by one of the output pins in group 7100-P5 passing through a closed switch 7801 and continuing through column data lines 7820. A switch closure of this sort also triggers the wake up key-detection circuit 7890 consisting of three AND gates 7891, 7892, 7893 which are configured to send a signal to interrupt 7100-P7 of microcontroller 7100.

Indicator Circuit (7700)

Indicator means (7700) for indicating the mode of either a message received or of a key 7801 depression is selectively included. This is done by lights 330 through 337 of FIG. 3.

The indicator circuit is composed of eight LEDs 7710, which are photodiodes and emit light into an indicator window when one of the ports is activated through the microprocessor 7101. The eight photodiodes 7700-LED1 through 7700-LED8 are arranged in parallel with each other. Between the photodiode's network and the pin group 7100-P8 is the resistor network 7720 which includes a resistor in series with diodes for each pin.

Hardware/Software Link through MIDI

MIDI is a language which contains a total of 256 "words" transmitted or received. The list is split in half creating two classes of 128 words each. These are status words and data words. Status words or status bytes can be thought of as the action or command part of a "sentence." Data words provide key information which extends the meaning of the status word (command). Because of this, some commands require one or two additional words (and in special cases, many more) to be very specific about what actions are to occur, and some can complete their tasks without any data words at all.

The first 128 numbers which express numerical values from 0 to 127 are data bytes. The numbers 128 and continuing to 255 determine which command needs to be executed and are known as status bytes.

In most cases, channel information of a MIDI cable is encoded into the status byte (channelization). This was designed into the MIDI language by duplicating a given message for each of the 16 channels which exist on any MIDI cable and altering them slightly so that each is unique. Thus, with a cluster of 16 commands in counting-integer sequence order, this means that instead of having just one command represent (for example) "Note-On" there would be 16. Any time a command refers to a specific channel, there will always be 16 variations of the command—they all perform the same function—with the exception that they inherently send the information down the proper channel. By creating 16 different status words to say essentially the same thing only with a twist, a data word to indicate the unique channel we wish to communicate upon is avoided. Because of this, many commands are actually defined as a group of 16 command words (status bytes) in the MIDI language.

System Exclusive commands (Sysex commands) are a catch-all command extension which allows flexible communication between MIDI devices when the basic language is insufficient. A unique product can do special things when it hears a Sysex message designated for it. The transceiver 100 makes extensive use of this provision.

The IMA MIDI spec. 1.0 uses binary numbers (0's and 1's) to indicate most values. It also occasionally uses the hex (base 16) numbering system (counting through 0, 1, 2, 3, 4, 5, 6, 7, 8, 9, A, B, C, D, E, and F to represent the numbers from 0 to 15). In a regular number like 128 there are 3 "place values." These are: the one's place, the ten's place, and the hundred's place. For 128, there exists (one) hundred, (two) tens, and (eight) ones. By multiplying the digit in a particular place by its place value and adding the resulting products of each place holder together, you determine the total value of the number as in 100+20+ 8. Because the human numbering system is based on ten values from 0 to 9, each place holder is ten times bigger than the one to the right of it. In contrast, the binary numbers system (base 2) is based on 2 values counting from 0 to 1. Because of this, each place holder in a binary number is only 2 times bigger than its neighbor to the right. Therefore, we have the one's place, the two's place, the four's place, the eight's place, the sixteen's place, the 32's place, the 64's place and the 128's place. The number 128 in binary would then equal 10000000. A "1" in the 128's place means (one) one-hundred-and-twenty-eight. Zero multiplied by all of the successively smaller place values to the right equals zero, so after adding up all of the products you end up with 128. All status bytes (command words) will have a "1" in the left-most digit of a binary number (the high bit, the most significant bit, or the MSB). All data values have a "0" in this place holder.

Hex values are an equally strange numbering system based on 16 values from 0 to 15. The two place holders are the one's place and the 16's place. The counting values are 0, 1, 2, 3, 4, 5, 6, 7, 8, 9, A, B, C, D, E, and F. (A=10, B=11, C=12, D=13, E=14, and F=15.) Any number for 0 to 15 can be expressed as a single digit in hex. Any number from 0 to 255 can be expressed as a 2-digit hex value. An "H" usually follows any hex number to indicate its base. So 9H=9 and BH=11 and 10H (one) sixteen and (zero) ones=16.

A byte can be expressed in two smaller chunks known as nibbles. Since each nibble consists of four binary digits (bits), a nibble can express a value from 0 to 15: the same as a single hex digit. Because this single hex digit can represent up to 16 different values, it is a convenient single digit to represent the specific channel that a command is to access. Any command which accesses a specific channel will always have the left-most hex digit representing the command while the right-most digit represents the channel. When expressed as an 8-digit binary number, the 4 left-most digits represent the command while the 4 right-most digits represent the channel. This is the reason that many commands are defined in binary terms with the 4 right-most digits replaced by letters (i.e. "Note ON"=1000nnnn). The n's represent the 16 different variations of the command, one for each channel. Therefore, the following 16 status bytes represent a Note-On message for each channel. Additional data bytes would indicate the note and velocity required.

| | | |
|---|---|---|
| 10000000 | 80 H | Note-On channel 1 |
| 10000001 | 81 H | Note-On channel 2 |

-continued

| | | |
|---|---|---|
| 10000010 | 82 H | Note-On channel 3 |
| 10000011 | 83 H | Note-On channel 4 |
| 10000100 | 84 H | Note-On channel 5 |
| 10000101 | 85 H | Note-On channel 6 |
| 10000110 | 86 H | Note-On channel 7 |
| 10000111 | 87 H | Note-On channel 8 |
| 10001000 | 88 H | Note-On channel 9 |
| 10001001 | 89 H | Note-On channel 10 |
| 10001010 | 8A H | Note-On channel 11 |
| 10001011 | 8B H | Note-On channel 12 |
| 10001100 | 8C H | Note-On channel 13 |
| 10001101 | 8D H | Note-On channel 14 |
| 10001110 | 8E H | Note-On channel 15 |
| 10001111 | 8F H | Note-On channel 16 |

Data values and Status Bytes

| Decimal | Binary | Hex | Description |
|---|---|---|---|
| 0–127 | 00000000–01111111 | 00 - 7F | Data value used in conjunction with a status word (command) |
| 128–255 | 10000000–11111111 | 80 - FF | All commands (status words) |
| | Status Bytes (in more detail) | | |
| 128–239 | 10000000–11101111 | 80 - EF | Channel-specific messages which refer to the actual sound heard. (Notes on and off, key pressure, control changes, pitch bend) |
| 176–191 | 10110000–10111111 | B0 - BF | Unique subset of channel specific messages which, in addition to changing controls, determine how the device reacts to data when the 1st data byte is between 122–127. (i.e. look at all channels, or just look at a specific channel, etc.) |
| 240 | 11110000 | F0 | System Exclusive (provided for expansion) |
| 241–247 | 11110001–11110111 | F1 - F7 | System Common messages such as Song Position Pointer, Song Select #, tune request, end of system exclusive, etc. |
| 248–255 | 11111000–11111111 | F8 - FF | System Real Time (timing information for synchronization of multiple systems) |

Voice Control Of Equipment

The transceiver 100 can implement voice control of IR devices 125. This would be handled as follows:

The transceiver initially needs to be programmed with the proper IR codes necessary to operate the desired IR device 125. This is accomplished by teaching specific keys 360 on the transceiver 100 to duplicate the IR codes of the original remote control. To copy a VCR play command from an original remote, first press the "teach" button on the transceiver keypad 301. Then press the button to be taught on the transceiver keypad 301. At this point, the "teach" LED 337 is flashing and the "Keypad" LED 332 is lit. A remote control **115*a* or 115*b* is fired into the front of the transceiver 10** until the IR LED lights up. After about 2 seconds, all LEDs go off and the teaching is complete. To teach more commands, repeat this procedure.

Now that the transceiver 100 has been taught its IR commands, it now needs to be taught the associated MIDI commands. The same procedure is carried out as above with the exception that the teaching keys on the transceiver 100 are to learn a MIDI message instead of an IR message. This basically creates a 3-way lookup table with 3 columns. The first column is the key number, as in which one of 64 possible keys on the transceiver keypad 301 are we referring to. The second column is the pointer to an IR message associated with each respective key on the transceiver keypad 301. The third column is the pointer to a MIDI message associated with each respective key on the transceiver keypad 301. A received message of any type will trigger a corresponding transmission of the other two types of messages as applicable.

In practice, however, the only time two messages come out of the transceiver 100 is when a key on the transceiver keypad 301 is pressed. Otherwise, if an IR message is received, then a MIDI message is transmitted. If a MIDI message is received, then an IR Message is transmitted. A "keypad" message would not normally be sent. However, indicator lights under each key *could* light up in response to a message from either the IR or MIDI domain.

With a programmed transceiver 100, control of devices 125, 159, or 169 is possible. An additional piece of software which resides in computer 169 or 170 performs the actual functions. The computer 170 equipped with a voice recognition device substitutes text for spoken words. The computer program translates the text provided by the voice recognition device into a MIDI command. The command, in turn, is sent from the computer 170 to the MIDI interface 174 and ultimately to the transceiver 100 which in turn broadcasts an IR message to a VCR or other IR device 125. Means are provided with the voice recognition software to train it to recognize spoken words. The additional software in the computer 170 which works with the transceiver 100 provides the means for determining which command is executed in response to the translated spoken word. A "teach" function also simplifies the process.

Exemplary Applications

There are many ways in which the transceiver 100 may operate.

For instance, it may be used as an automatic trigger for any IR action, such as turning on a CD player. The transceiver 100 can send commands to an IR device 125, for example, to start a CD player at a "specific and repeatable" spot.

The transceiver 100 may also be used with a stand-alone program to control IR devices 125. For example, two VCRs could be automatically cued and played if the video tapes are time coded. The VCRs could be cued according to a computer program which selects songs according to any desired criteria, for example, the speed of the songs. In such a capacity, the transceiver 100 acts as an automatic disc jockey to play only fast songs at a certain time period or for a certain event.

With such a system, the transceiver 100 can be set up with two permanent IR devices 125 such as two VCRs. Each VCR could be set up with a single video tape with six hours of music videos and automatically played provided the two video tapes are encoded with SMPTE time code. This is an audio signal which counts the passing of time in increments of 1/30th of a second. A SMPTE to MIDI converter can be incorporated in the microprocessor 7101 of the microcontroller 7100 such that the time code is read in a MIDI domain. Such MIDI information would be transmitted through the transceiver 100, interface 174 to computer 170. A program in the computer 170 will permit a user to list names and locations of material and songs on the tapes on the VCR 125. Decisions can then be made on which songs to play at particular times, and this information is programmed into the computer 170 and in turn through the system operates the two VCRs 125 as required.

In another capacity, the transceiver 100 could operate animation programs such that the operator of the transceiver 100 can direct an animated sequence as desired. Such an animated program is known as Director (Trademark) from MacroMind Inc. (Trademark) which permits the creation of a visual presentation on a computer. Data is stored on a hard disk system and played back via a computer. Thus, when using computer 170 for the program, the transceiver 100 through the MIDI interconnect 150 and 163 and MIDI interface 164 can operate such a program. Thus, a MIDI device 20 through cable 153 and 163 and MIDI interface 164 can operate computer 170, as necessary.

Another capacity, the transceiver 100 is used in conjunction with a computer 169 for input of MIDI messages which are interpreted by the computer 170 and sent back to the transceiver 100 to provide an "intelligent" IR device control. "Intelligent" means that the computer 169/170 makes decisions about a set of message inputs according to programmer criteria. The computer 169/170 could interpret the pressing of any power button to mean that the power for all the controlled devices should be turned on. After such interpretation, the computer 170 outputs a stream of MIDI messages to the interface 174 and in turn to the transceiver 100 to send the appropriate IR commands to power up desired IR devices 125.

Another exemplary application is for voice-activated control of IR devices 125. A speech recognition system converts voiced words into computer commands which can fire MIDI commands. These MIDI commands can be sent to transceiver 100 for translation into associated IR messages of a type recognizable by IR devices 125.

Ordinarily the transceiver 100 is used as the sole interactor with an operator between the various IR devices 125 and MIDI devices 179, 159, and 169/170 (interconnected through MIDI interfaces 175/165, interconnected through their respective computers via cables 171*a* and 167*a*, respectively. The capability also exists to use multiple transceivers 100 in the network. This could effect a translation from, for example, MIDI to IR, and then a second translation from IR back to MIDI again.

The transceiver 100 is not limited to receiving IR messages only from remote control devices for Audio/-Visual equipment. Any IR message data can be transformed into a format which can be interpreted by a computer that has been pre-programmed with appropriate conversion algorithms. A device such as an electronic Rolodex 116 (which is designed to send data to other Rolodexes via IR) could then be prompted to send its data to the transceiver which could translate it into an appropriate form recognizable by the pre-programmed computer 169 interconnected with the MIDI interface 165.

IR messages can be transmitted directly from the transceiver keypad 301 to IR devices 125 such as TVs, CDs and VCRs. By use of the TEACH key 317, an IR message to operate a selected IR device 125 can be programmed into the transceiver 100.

IR messages to IR devices 125 are invoked by operating a MIDI device 179 or 170, for instance, by activating a note-ON message to be received at the MIDI input of the transceiver 100. An IR message can be relayed specifically to a selected IR device. Thus, a particular MIDI input message to the transceiver 100 is translated to control a particular IR device. This MIDI input may be a standard MIDI command or a System Exclusive message which describes the desired IR output.

In a different fashion, the transceiver 100 receives an IR message and translates this into a MIDI message to operate a MIDI device 159, 169. The resulting MIDI message can be either a standard MIDI command or a System Exclusive message representing the IR input as a series of on and off pulses that can be identified by the receiving MIDI device (normally a computer 169 interconnected to a MIDI interface 165).

The keypad 301 can direct-play any MIDI message or command to operate MIDI equipment.

The transceiver 100 emulates a universal remote control 115*a* or 115*b*. After completing teaching the buttons on the transceiver keypad 301 to transmit IR messages, the transceiver 100 is ready. Pressing any programmed key 360 on the transceiver keypad 301 causes the transmission of the associated (taught) IR command.

The transceiver 100 can be used to send messages to a computer 169 via MIDI. The program running on the computer 169/170 would be responsible for interpreting the message and determining what action to take. After teaching the keys on the transceiver keypad 301 to transmit MIDI messages the transceiver 100 is ready. Pressing a key 360 sends an associated MIDI message. The computer 169/170 receives the message and initiates some action within the computer system. This could even include the possibility of generating a new MIDI message, sending it out of the computer 170 and back into the transceiver 100 where it ultimately transmits a specific IR message. This is an interactive use of the transceiver 100.

Many more examples of the invention exist, each differing from this in detail only. The scope of the invention is determined solely by the appended claims.

I claim:

1. Apparatus for communicating information between at least two different domains wherein a first domain is a MIDI domain and a second domain is an IR domain, comprising:

a. input means for receiving a first signal in the MIDI domain from an independently operable MIDI device;

b. transceiver means for receiving the first signal, the transceiver means including microprocessor means for translating the first signal; and c. output means for receiving the translated first signal and for outputting the translated first signal as a second signal, such second signal being in the IR domain, and such second signal being for operating an independently operable IR device.

2. Apparatus for communicating information between at least two different domains wherein a first domain is an IR domain and a second domain is a MIDI domain, comprising:

a. input means for receiving a first signal in the IR domain from an independently operable IR device;

b. transceiver means for receiving the first signal, the transceiver means including microprocessor means for translating the first signal; and c. output means for receiving the translated first signal and for outputting the translated first signal as a second signal, such second signal being in the MIDI domain, and such second signal being for operating an independently operable MIDI device.

3. Apparatus as claimed in either claim 1 or claim 2 wherein the transceiver includes software translation means to effect a transformation.

4. Apparatus as claimed in either claim 1 or 2 wherein the software translation means includes a multi-way table-look-up system to effect a transception.

5. Apparatus as claimed in claim 4 wherein the software table-look-up system includes:

a. tables for selected Keypad codes;

b. tables for selected MIDI codes;

c. tables for selected IR codes;

d. means for detecting whether a KEYPAD, MIDI, or IR input signal is associated with at least one of the tables of a., b., or c;

e. index means for referencing data between the selected KEYPAD, IR codes and MIDI codes; and f. means for selecting an output signal using the index to provide a signal in a selected KEYPAD, MIDI or IR domain.

6. Apparatus as claimed in claim 4 wherein the KEYPAD, IR and MIDI tables are created by the transceiver.

7. Apparatus as claimed in claim 4 wherein the KEYPAD, IR and MIDI tables are created by a computer.

8. Apparatus as claimed in either claim 1 or claim 2 wherein the transceiver includes memory means having address and data latch coupled with a permanent address and data storage for reading and writing from the microprocessor means.

9. Apparatus as claimed in either claim 1 or claim 2 including keypad means including selectively preset or programmable keys for selectively controlling the KEYPAD, IR or MIDI output means.

10. Apparatus of claim 9 wherein the keypad means includes:

a: learning or teaching means for enabling a key on the keypad to generate a first signal which can be selectively translated to a desired second signal in an alternate domain; and b: means for selectively outputting a second signal for operation of a device appropriate to the domain of second signal.

11. Apparatus of claim 7 including visual indicator means for selectively indicating the domains, and the operative or signalling status of the transceiver.

12. Apparatus for communicating between a signal of the MIDI domain and a signal of the IR domain comprising:

a. a transceiver for receiving and outputting IR signals and for receiving and outputting MIDI signals; and b. microprocessor means in the transceiver for translating signals between the MIDI domain and the IR domain, and c. wherein the IR signal is related to an independently operable IR device and the MIDI sequence is related to an independently operable MIDI device.

13. Apparatus as claimed in claim 12 wherein the transceiver includes controller means, the controller means being operable for directing signals in a selected domain between one or more selected MIDI or IR devices.

14. Apparatus as claimed in claim 12 including a manually operable keyboard.

15. Apparatus as claimed in claim 12 wherein the transceiver includes a program for receiving and transmitting signals thereby permitting a selected MIDI or IR device to be interactive with the transceiver.

16. Apparatus as claimed in claim 12 including a MIDI interface, the MIDI interface being operational with selectively a computer, an audio-visual device, multimedia device, MIDI device, or voice activation device.

17. Apparatus as claimed in claim 12 wherein the transceiver includes output means for outputting IR signals to an IR device and connect means for connecting a MIDI device with the transceiver.

18. Apparatus as claimed in claim 12 including means for manually interacting with the transceiver for operating at least one of an IR or MIDI device.

19. Apparatus as claimed in claim 12 including means for operating the transceiver whereby signals respectively in the MIDI or IR domain are translated to operate a device active in the IR or MIDI domain.

20. Apparatus for communicating comprising:

a. a first transceiver for receiving a first IR signal and for translating and outputting a second signal in a MIDI domain to a second transceiver, b. microprocessor means in the transceiver of a. for translating signals between the first IR signal and the second MIDI signal, c. a second transceiver for receiving the translated second signal of the MIDI domain and for translating and outputting a third signal as an IR signal and;

d. microprocessor means in the second transceiver of c. for translating signals between the received second signal in the MIDI domain and the third IR output signal, and wherein the first and third IR signals are selectively different.

21. Apparatus as claimed in claim 20 wherein the transceiver includes controller means, the controller means being operable for translating the IR signals through a MIDI domain device.

22. Apparatus as claimed in claim 20 including a manually operable keyboard.

23. A method of communicating information between at least two different domains wherein the first domain is a MIDI domain and the second domain is an IR domain comprising selectively transceiving or transforming a MIDI signal with a microprocessor, and selectively transceiving or transforming an IR signal with a microprocessor, selectively translating at least one of a MIDI signal to the microprocessor to an IR signal, or an IR signal to the microprocessor to a MIDI signal, and wherein MIDI signals and IR signals are respectively translated between the respective domains, and wherein the signals are signals for relation to independently operable devices.

24. A method as claimed in claim 23 wherein a MIDI signal is an input signal to the microprocessor, and the IR signal is an IR output signal, the MIDI signal being received from a remote MIDI device and the output signal being for transmission to a remote IR device whereby the MIDI device controls the IR device.

25. A method as claimed in claim 23 including controlling the microprocessor to selectively signal between a selected independently operable MIDI device and a selected independently operable IR device, or a selected independently operable IR device and a selected independently operable MIDI device.

26. A method as claimed in claim 25 including controlling the microprocessor to operate selectively with a computer, audio visual device, multimedia device, MIDI device, or voice activation device.

* * * * *